US010137720B2

(12) United States Patent
Hudachek

(10) Patent No.: US 10,137,720 B2
(45) Date of Patent: Nov. 27, 2018

(54) ILLUMINATED ASSEMBLY

(71) Applicant: Susan Francesca Hudachek, Severance, CO (US)

(72) Inventor: Susan Francesca Hudachek, Severance, CO (US)

( * ) Notice: Subject to any disclaimer, the term of this patent is extended or adjusted under 35 U.S.C. 154(b) by 387 days.

(21) Appl. No.: 14/903,578

(22) PCT Filed: Sep. 12, 2014

(86) PCT No.: PCT/US2014/055323

§ 371 (c)(1),
(2) Date: Jan. 7, 2016

(87) PCT Pub. No.: WO2015/038857

PCT Pub. Date: Mar. 19, 2015

(65) Prior Publication Data

US 2016/0159133 A1 Jun. 9, 2016

Related U.S. Application Data

(60) Provisional application No. 61/876,762, filed on Sep. 12, 2013.

(51) Int. Cl.

| | |
|---|---|
| ***B42D 3/12*** | (2006.01) |
| ***F21V 33/00*** | (2006.01) |
| ***F21W 131/30*** | (2006.01) |

(52) U.S. Cl.

CPC ..... *B42D 3/123* (2013.01); *F21V 33/0004* (2013.01); *B42P 2241/16* (2013.01); *F21W 2131/3005* (2013.01)

(58) Field of Classification Search

CPC . B24D 3/123; G09F 13/08; G09F 2013/1854; B42P 2241/16; F21W 2131/3005

USPC ..... 362/98

See application file for complete search history.

(56) References Cited

U.S. PATENT DOCUMENTS

| | | | |
|---|---|---|---|
| 3,622,771 | A | 11/1971 | Franc |
| 4,209,824 | A | 6/1980 | Kaufman |
| 4,363,081 | A | 12/1982 | Wilbur |
| 5,118,138 | A | 6/1992 | Brotz |
| 5,167,508 | A | 12/1992 | McTaggart |
| 5,301,982 | A | 4/1994 | Brotz |
| 5,381,310 | A | 1/1995 | Brotz |

(Continued)

FOREIGN PATENT DOCUMENTS

| | | | | |
|---|---|---|---|---|
| DE | 10 2010 055551 | A1 | 6/2012 | |
| DE | 102010055551 | A1 * | 6/2012 | ..... B42D 1/007 |
| GB | 2 474 583 | A | 4/2011 | |

OTHER PUBLICATIONS

Machine translation of Luecke, DE 102010055551, published Jun. 28, 2012 (Year: 2012).*

(Continued)

*Primary Examiner* — William N Harris

(74) *Attorney, Agent, or Firm* — Susan F. Hudachek

(57) ABSTRACT

Generally, an illuminated assembly and methods for making and using illuminated assemblies. Specifically, an illuminated assembly including a plurality of pages, whereby each of the plurality of pages can be coupled to a light source which provides light to one or more page surfaces such that the light can be viewed by a viewer of the one or more page surfaces.

24 Claims, 19 Drawing Sheets

(56) References Cited

U.S. PATENT DOCUMENTS

| | | | | |
|---|---|---|---|---|
| 5,460,414 | A | 10/1995 | Sargis | |
| 5,599,048 | A * | 2/1997 | Schioler | B42D 1/009 281/22 |
| 5,992,068 | A * | 11/1999 | de Saro | G09F 13/08 40/564 |
| 6,951,403 | B2 | 1/2005 | Bennett | |
| 7,490,948 | B2 | 2/2009 | Fisherman et al. | |
| 7,656,580 | B2 | 2/2010 | Chang | |
| 8,087,794 | B2 | 1/2012 | Stravinskas et al. | |
| 2009/0286072 | A1* | 11/2009 | Kuchler | B60K 37/06 428/336 |
| 2013/0341900 | A1* | 12/2013 | Lazzari | B41M 3/148 283/75 |

OTHER PUBLICATIONS

Zach Honig, Wired's LED-powered Moto X ad lets you try custom colors before you buy; https://www.engadget.com/2013/12/19/moto-x-wired/; page captured on Feb. 22, 2017.

Extended European Search Report for corresponding EPO Patent Application No. 14844578.6; 8 pages total.

International Search Report (ISR) for corresponding PCT International Patent Application No. PCT/US2014/055323; ISR = 2 total pages.

Written Opinion (WO) for corresponding PCT International Patent Application No. PCT/US2014/055323; WO = 6 total pages.

Lite the Nite Books Website, Oct. 6, 2016. Website, http://www.litethenitebooks.com/.

* cited by examiner 111
110

109
68/70
110
9
36
9
36
111
5
5

36
9
36
9
111
110
5
5

110
111

67
68/70

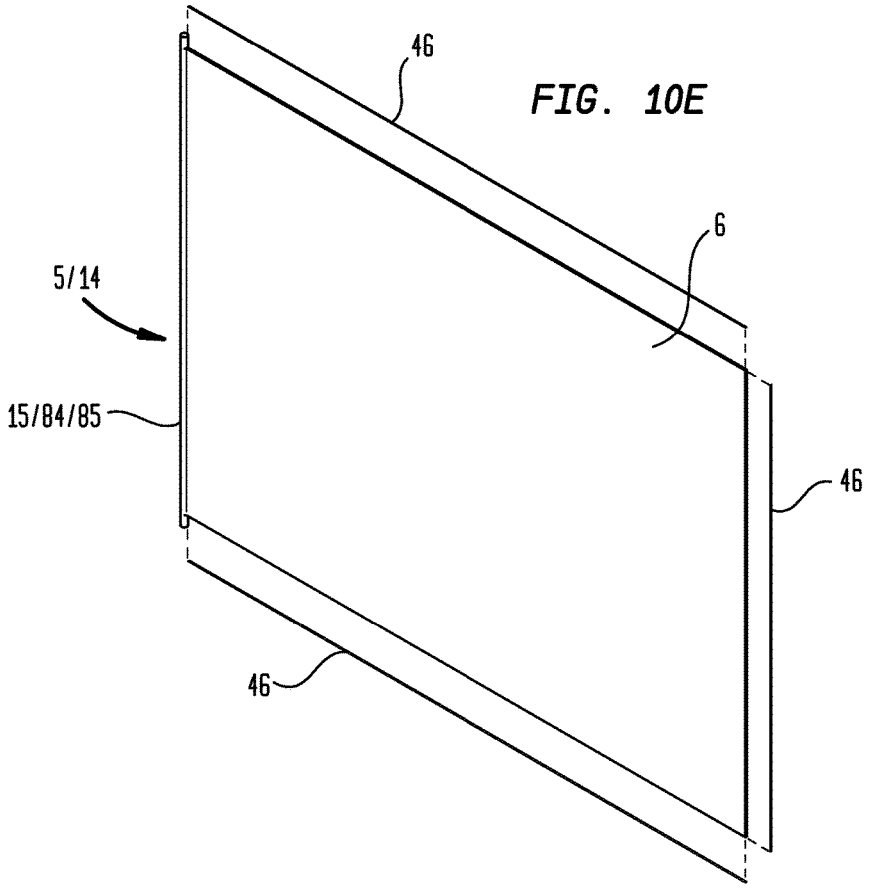
FIG. 10E
FIG. 10F
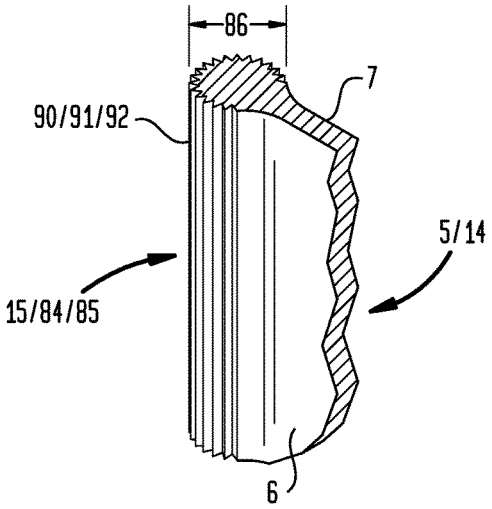
FIG. 10G
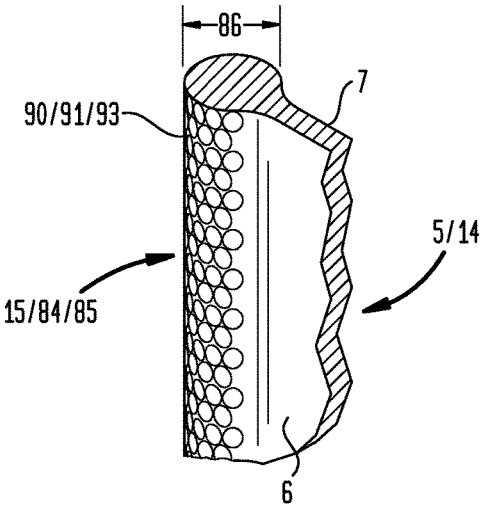

ILLUMINATED ASSEMBLY

This application is the United States National Stage entry of International Patent Cooperation Treaty Patent Application No. PCT/US14/55323, filed Sep. 12, 2014, which claims the benefit of U.S. Provisional Patent Application No. 61/876,762, filed Sep. 12, 2013, each hereby incorporated by reference herein.

I. TECHNICAL FIELD

Generally, an illuminated assembly and methods for making and using illuminated assemblies. Specifically, an illuminated assembly including a plurality of pages, whereby each of the plurality of pages can be coupled to a light source which provides light to one or more page surfaces such that the light can be viewed by a viewer of the one or more page surfaces.

II. BACKGROUND

A need exists for a book having pages which can be viewed without an external light source, particularly in a low-light or dark environment.

III. DISCLOSURE OF INVENTION

A broad object of a particular embodiment of the invention can be to provide an illuminated assembly including a plurality of pages coupled to one another, whereby each page includes a panel having a panel first surface opposite a panel second surface; a first sheet having a first sheet front surface opposite a first sheet back surface, the first sheet back surface coupled to the panel first surface; and at least one first sheet light transmission portion disposed within the first sheet, the first sheet light transmission portion communicating between the first sheet front and back surfaces. The illuminated assembly further includes a light source operatively coupled to each panel, the light source in an activated condition provides light to each corresponding panel first surface; whereby the light is transmitted from each panel first surface through each corresponding first sheet light transmission portion such that the light is viewable by a viewer of the first sheet front surface.

Another broad object of a particular embodiment of the invention can be to provide an illuminated assembly whereby each page further includes a second sheet having a second sheet front surface opposite a second sheet back surface, the second sheet back surface coupled to the panel second surface; and at least one second sheet light transmission portion disposed within the second sheet, the second sheet light transmission portion communicating between the second sheet front and back surfaces. The light source in the activated condition provides light to each corresponding panel second surface, whereby the light is transmitted from each panel second surface through each corresponding second sheet light transmission portion such that the light is viewable by a viewer of the second sheet front surface.

Another broad object of a particular embodiment of the invention can be to provide a method of producing an illuminated assembly, the method including coupling a plurality of pages to one another, each page produced by providing a panel having a panel first surface opposite a panel second surface; providing a first sheet having a first sheet front surface opposite a first sheet back surface; disposing at least one first sheet light transmission portion within the first sheet, the first sheet light transmission portion communicating between the first sheet front and back surfaces; and coupling the first sheet back surface to the panel first surface. The method further includes operatively coupling a light source to each panel, the light source in an activated condition provides light to each corresponding panel first surface; whereby the light is transmitted from each panel first surface through each corresponding first sheet light transmission portion such that the light is viewable by a viewer of the first sheet front surface.

Another broad object of a particular embodiment of the invention can be to provide a method of producing an illuminated assembly, the method further including producing each page by providing a second sheet having a second sheet front surface opposite a second sheet back surface; disposing at least one second sheet light transmission portion within the second sheet, the second sheet light transmission portion communicating between the second sheet front and back surfaces; and coupling the second sheet back surface to the panel second surface. The light source in the activated condition provides light to each corresponding panel second surface, whereby the light is transmitted from each panel second surface through each corresponding second sheet light transmission portion such that the light is viewable by a viewer of the second sheet front surface.

Naturally, further objects of the invention are disclosed throughout other areas of the specification, drawings, and claims.

IV. BRIEF DESCRIPTION OF THE DRAWINGS

FIG. 10E is a perspective view of a particular embodiment of a panel which can be included in the inventive illuminated assembly, whereby the panel includes a generally cylindrical panel first edge and whereby the panel includes reflective elements coupled along panel second, third, and fourth edges.

FIG. 10F is an enlarged view of the particular embodiment of the generally cylindrical panel first edge shown in FIG. 10B, whereby a generally cylindrical panel first edge external surface can be configured as a bellowed surface.

FIG. 10G is an enlarged view of the particular embodiment of the generally cylindrical panel first edge shown in FIG. 10B, whereby a generally cylindrical panel first edge external surface can be configured as a dimpled surface.

V. MODE(S) FOR CARRYING OUT THE INVENTION

Figure 1:
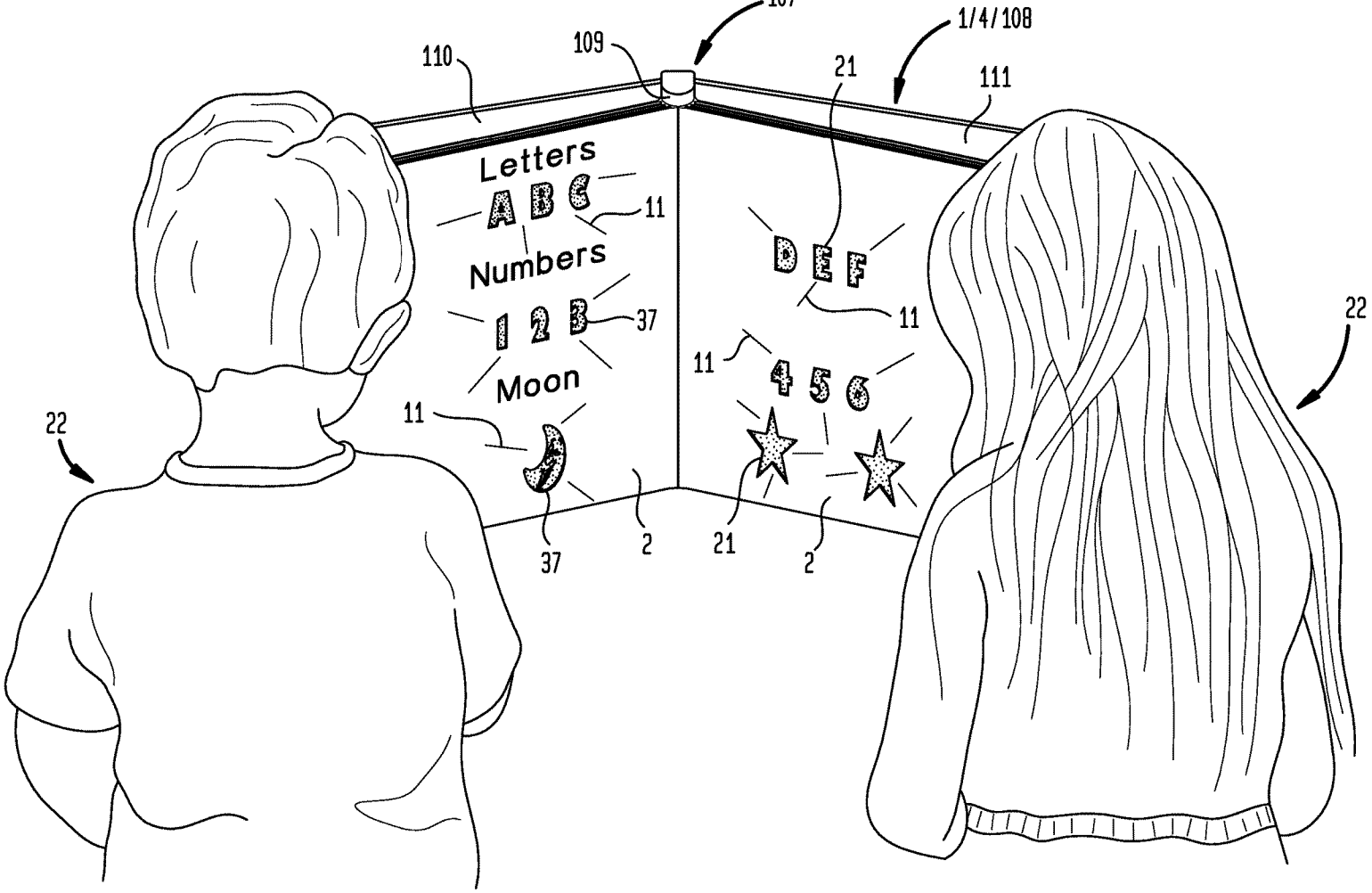
FIG. 1 is an illustration of a method of using a particular embodiment of the inventive illuminated assembly.
Figure 2:
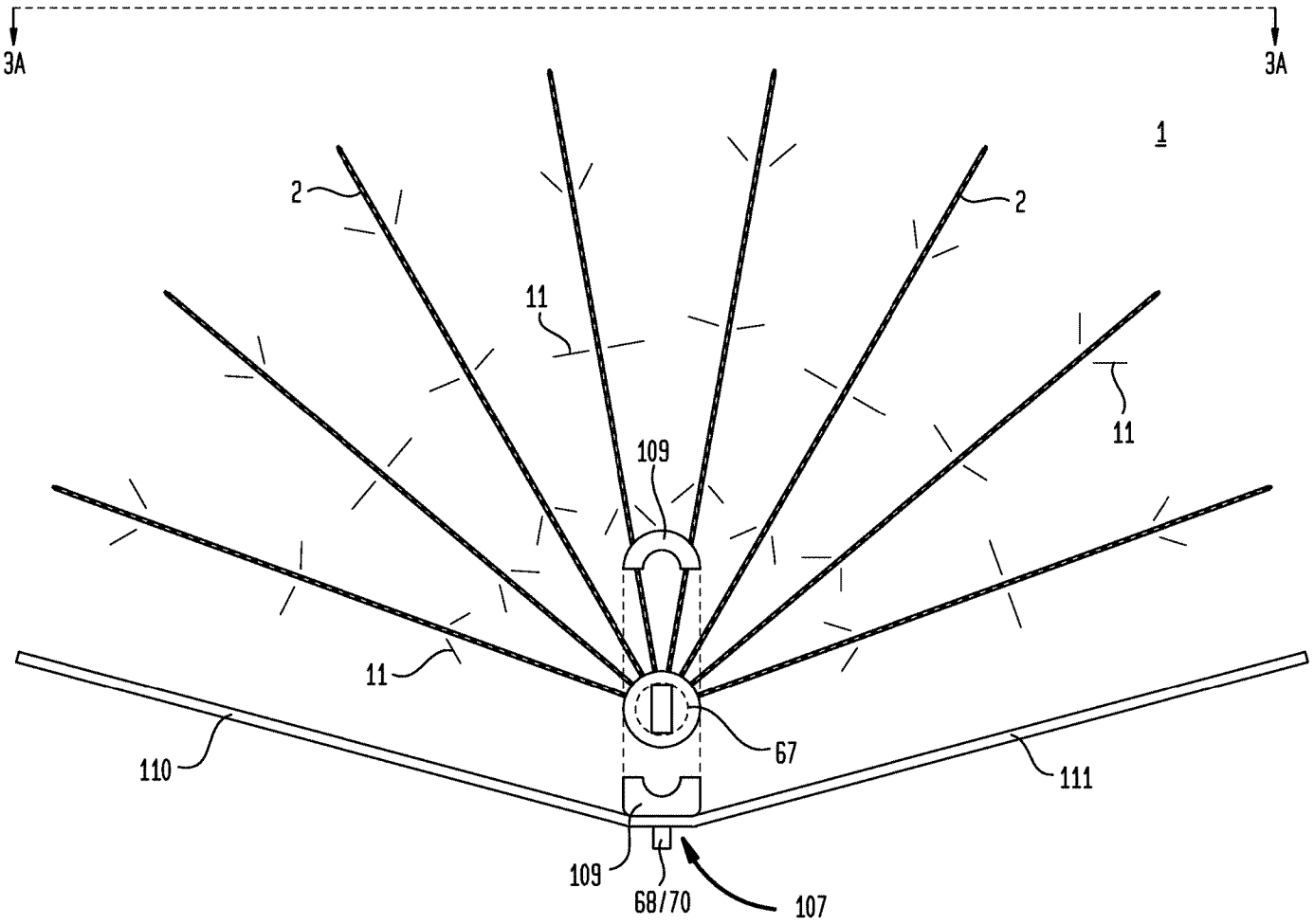
FIG. 2 is a bottom view of a particular embodiment of the inventive illuminated assembly.

Now referring primarily to FIG. 1, which illustrates a method of using a particular embodiment of an inventive illuminated assembly (1), including at least one page (2) and a light source (3) operatively coupled to the page (2), whereby the light source (3) in an activated condition (4) can illuminate at least a portion of the page (2). The method of use can include activating the light source (3) to the activated condition (4) and viewing the page (2) having at least a portion of the page (2) illuminated by the light source (3).

Now referring primarily to FIG. 2 through FIG. 13, a page (2) can include a panel (5) having a panel first surface (6) opposite a panel second surface (7) and a first sheet (8) having a first sheet front surface (9) opposite a first sheet back surface (10). The first sheet back surface (10) can be coupled to the panel first surface (6); accordingly, the first sheet (8) can be in overlapping engagement with the panel first surface (6). The panel (5) can further be operatively coupled to a light source (3), whereby the light source (3) in an activated condition (4) can provide light (11) to the panel first surface (6) (and, as to particular embodiments, the panel second surface (7)), thereby illuminating the panel first surface (6) (and, as to particular embodiments, the panel second surface (7)).

Now referring primarily to FIG. 10A through FIG. 10G and FIG. 13A through FIG. 13D, the panel first and second surfaces (6)(7) can be configured as generally planar panel first and second surfaces (6)(7) disposed a panel thickness (12) apart. As to particular embodiments, the panel thickness (12) can be a generally uniform panel thickness (12) typically in a range of between about 1 millimeter to about 10 millimeters. As to particular embodiments, the panel thickness (12) can be selected from the group including or consisting of: between about 1 millimeter to about 2 millimeters, between about 1.5 millimeters to about 2.5 millimeters, between about 2 millimeters to about 3 millimeters, between about 2.5 millimeters to about 3.5 millimeters, between about 3 millimeters to about 4 millimeters, between about 3.5 millimeters to about 4.5 millimeters, between about 4 millimeters to about 5 millimeters, between about 4.5 millimeters to about 5.5 millimeters, between about 5 millimeters to about 6 millimeters, between about 5.5 millimeters to about 6.5 millimeters, between about 6 millimeters to about 7 millimeters, between about 6.5 millimeters to about 7.5 millimeters, between about 7 millimeters to about 8 millimeters, between about 7.5 millimeters to about 8.5 millimeters, between about 8 millimeters to about 9 millimeters, between about 8.5 millimeters to about 9.5 millimeters, and between about 9 millimeters to about 10 millimeters, whereby a lesser panel thickness (12) can provide a page (2) having a lesser page thickness (13) and a greater panel thickness (12) can provide a page (2) have a greater page thickness (13).

Now referring primarily to FIG. 10A through FIG. 10G, the panel (5) can be a light-diffusing panel (14) configured to diffuse the light (11) provided by the light source (3). As to particular embodiments, the light-diffusing panel (14) can be formed from one or more polymeric materials, including thermoplastic polymers capable of being extruded or thermoformed, such as polycarbonate, acrylic polymers, polystyrene, polyvinyl chloride, polyvinylidene fluoride, polyvinylidene fluoride-acrylic copolymers, imidized acrylic polymers, cyclic olefin copolymers, polyolefins, polyesters, styrene acrylonitrile, acrylonitrile-acrylate copolymers, acrylonitrile-methyl methacrylate copolymers, methyl methacrylate-styrene copolymers, other styrenic polymers or copolymers containing alpha-methyl styrene, polyethylene terephthalate glycol-modified, methacrylate-butadiene-styrene terpolymer, acrylonitrile-styrene-acrylate terpolymer, acrylonitrile butadiene styrene terpolymer, polycyclo-hexylethylene, or the like, or combinations thereof. As an illustrative example, the thermoplastic polymer can be an acrylic polymer, such as poly(methylmethacrylate) (CAS number 9011-14-7). As to particular embodiments, the light-diffusing panel (14) formed from the thermoplastic polymer can be generally transparent, generally colorless, or a combination thereof.

The light-diffusing panel (14) can diffuse the light (11) provided by the light source (3) such that the light (11) generally uniformly illuminates the panel first surface (6) (and, as to particular embodiments, the panel second surface (7)). As to particular embodiments, the light-diffusing panel (14) can diffuse the light (11) provided by the light source (3) when the light (11) is provided proximate a panel first edge (15).

As to particular embodiments, the light-diffusing panel (14) can further include one or more light-diffusing elements (16) configured to diffuse the light (11) provided by the light source (3) such that the light (11) generally uniformly illuminates the panel first surface (6) (and, as to particular embodiments, the panel second surface (7)). As to particular embodiments, the one or more light-diffusing elements (16) can diffuse the light (11) provided by the light source (3) when the light (11) is provided proximate the panel first edge (15).

Figure 10A:
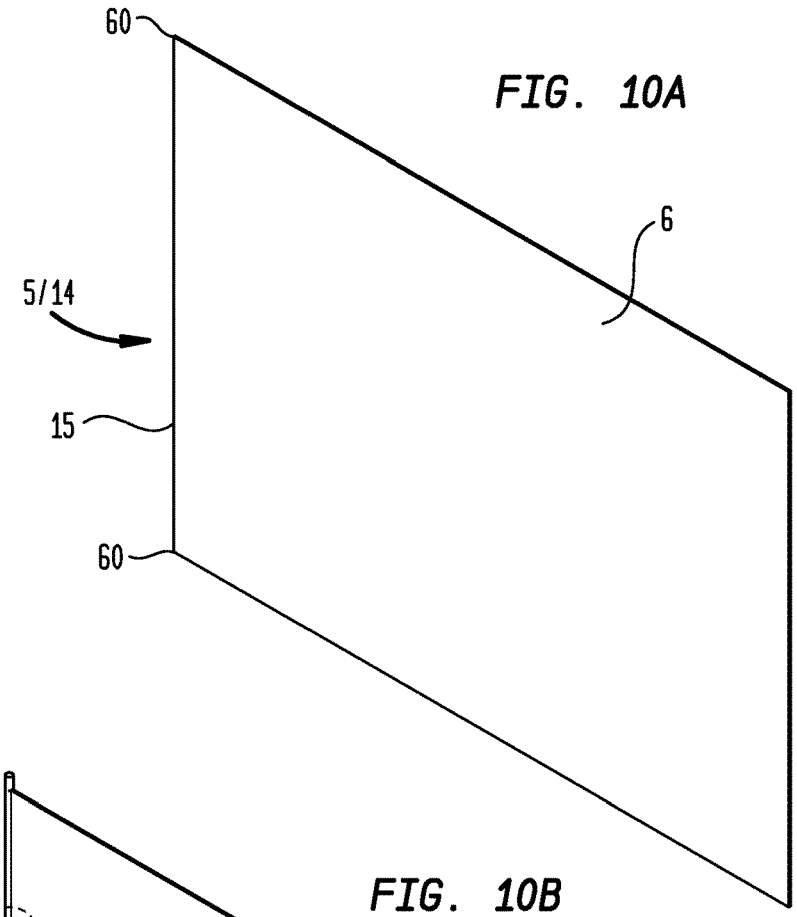
FIG. 10A is a perspective view of a particular embodiment of a panel which can be included in the inventive illuminated assembly.
Figure 10B:
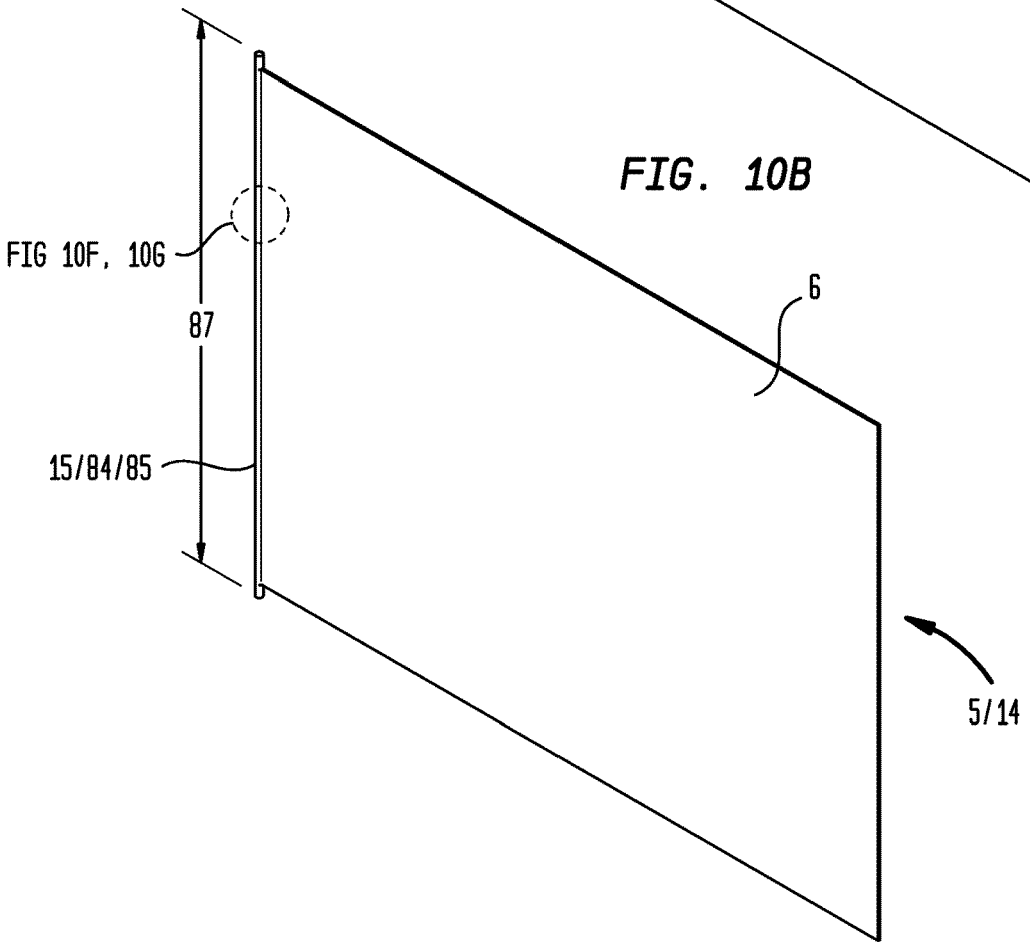
FIG. 10B is a perspective view of a particular embodiment of a panel which can be included in the inventive illuminated assembly, whereby the panel includes a generally cylindrical panel first edge.
Figure 10C:
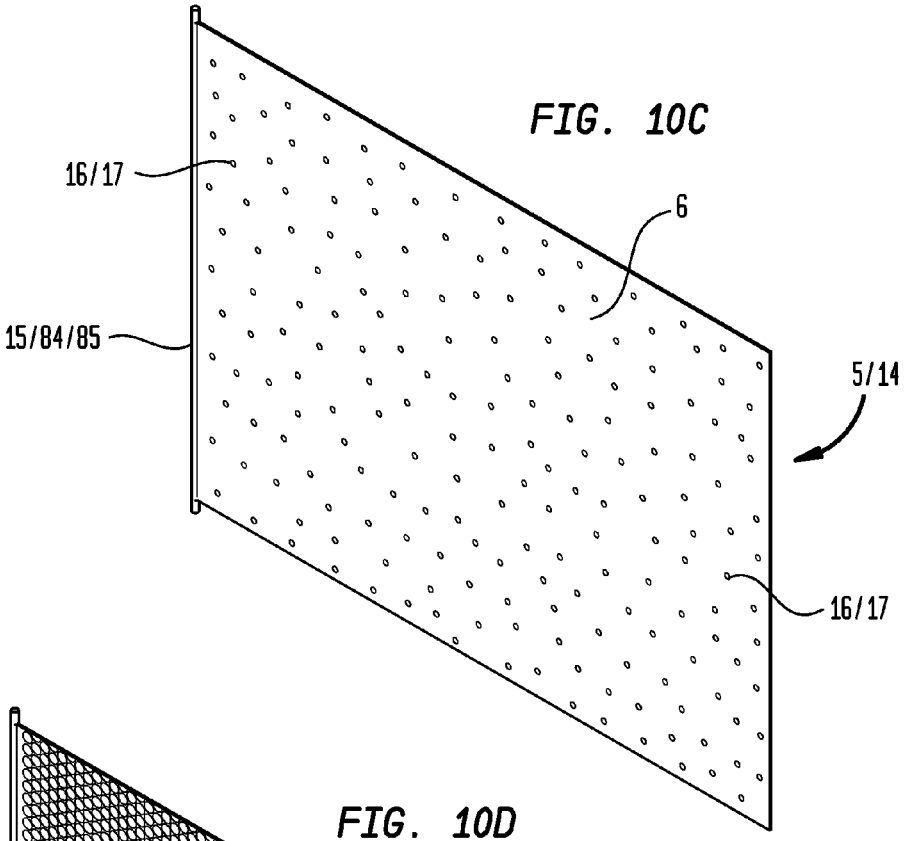
FIG. 10C is a perspective view of a particular embodiment of a panel which can be included in the inventive illuminated assembly, whereby the panel includes a generally cylindrical panel first edge and whereby the panel includes light-diffusing particles embedded within the panel.

Now referring primarily to FIG. 10C, as to particular embodiments, the light-diffusing element (16) can include light-diffusing particles (17) embedded within the light-diffusing panel (14), whereby the light-diffusing particles (17) can be configured to diffuse the light (11) provided by the light source (3) to generally uniformly illuminate the panel first surface (6) (and, as to particular embodiments, the panel second surface (7)).

As to particular embodiments having light-diffusing particles (17) which diffuse the light (11) provided by the light source (3) such that the light (11) generally uniformly illuminates the panel first surface (6) (and, as to particular embodiments, the panel second surface (7)), the light-diffusing particles (17) can diffuse the light (11) provided by the light source (3) when the light (11) is provided proximate the panel first edge (15). For example, when the light (11) is provided proximate the panel first edge (15), the light-diffusing particles (17) can function to deflect the light (11) and suppress total internal reflection in the panel (5), allowing the light (11) to exit the panel (5) via the panel first surface (6) (and, as to particular embodiments, the panel second surface (7)), thereby generally uniformly illuminating the panel first surface (6) (and, as to particular embodiments, the panel second surface (7)). As illustrative examples, light-diffusing panels (14) having light-diffusing particles (17) which may be useful for particular embodiments of the illuminated assembly (1) can include ACRYLITE® LED (EndLighten), which may be obtained from Evonik Cryo LLC, 299 Jefferson Road, Parsippany, N.J. 07054, USA; Plexiglas® ELiT II, which may be obtained from Arkema Inc., 100 PA Rt. 413, Bristol, Pa. 19007, USA; or LuciteLux® Light Guide Panel, which may be obtained from Lucite International Inc, 7275 Goodlett Farms Parkway, Cordova, Tenn. 38016, USA.

Figure 10D:
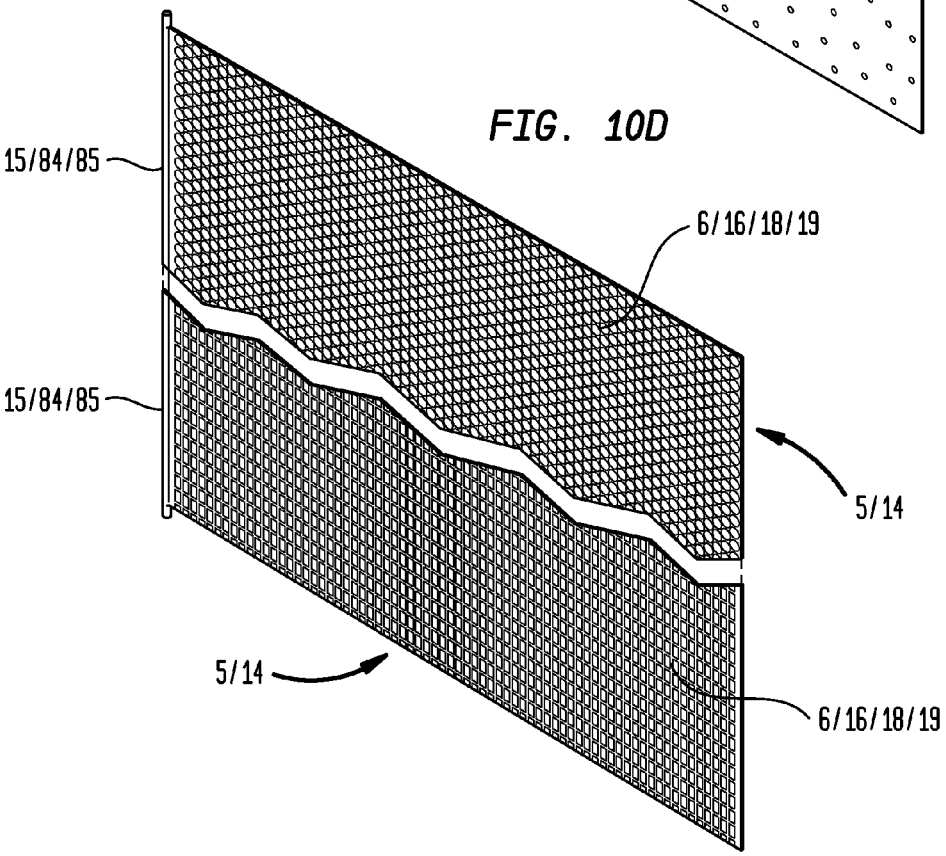
FIG. 10D is a perspective view of a particular embodiment of a panel which can be included in the inventive illuminated assembly, whereby the panel includes a generally cylindrical panel first edge and whereby the panel includes a pattern coupled to the panel.

Now referring primarily to FIG. 10D, as to other particular embodiments, the light-diffusing element (16) can include a textured layer (18) or pattern (19) coupled to the panel first surface (6) (and, as to particular embodiments, the panel second surface (7)), whereby the textured layer (18) or pattern (19) can function to produce a generally uniform illumination of the panel first surface (6) (and, as to particular embodiments, the panel second surface (7)) when the light source (3) provides the light (11) to the panel (5). The pattern (19) can include a dot pattern or dot matrix, a line pattern or line matrix, or the like, or combinations thereof, which can be printed, etched, or otherwise coupled to the panel first surface (6) (and, as to particular embodiments, the panel second surface (7)). As to particular embodiments, the textured layer (18) or pattern (19) can function to produce a generally uniform illumination of the panel first surface (6) (and, as to particular embodiments, the panel second surface (7)) when the light source (3) provides the light (11) proximate the panel first edge (15). As illustrative examples, light-diffusing panels (14) having a textured layer (18) or pattern (19) coupled to the panel first surface (6) (and, as to particular embodiments, the panel second surface (7)) which may be useful for particular embodiments of the illuminated assembly (1) can include Perspex® S-Lux, D-Lux, or Prismex®, which may be obtained from Lucite International Inc, 7275 Goodlett Farms Parkway, Cordova, Tenn. 38016, USA; LGP (Light Guide Panel/Plate), which may be obtained from Vivacity LED, LLC, 2830 Mary Street, Falls Church, Va. 22042, USA; or CLAREX® Light Guide Panel, which may be obtained from Astra Products, Inc., 6 Bethpage Road, Copiague, N.Y. 11726, USA.

Now referring primarily to FIG. 11 and FIG. 13A through FIG. 13D, the first sheet (8) can include a first sheet front surface (9) opposite a first sheet back surface (10), whereby the first sheet back surface (10) can be coupled to the panel first surface (6); accordingly, the first sheet (8) can be in overlapping engagement with the panel first surface (6).

The first sheet (8) can be formed from any of a numerous and wide variety of materials, depending upon the application. As illustrative examples, the first sheet (8) can be formed from paper, paper-like materials, plastic, fabric, or the like, or combinations thereof; however, the invention need not be so limited, as the first sheet (8) can be formed from any material which can couple to the panel (5) to provide a page (2) of the illuminated assembly (1).

The first sheet (8) can be coupled to the panel (5) using any of a numerous and wide variety of conventional coupling elements, such as adhesives, mechanical fasteners, or any coupling element or method of coupling which can couple the first sheet back surface (10) to the panel first surface (6).

Now referring primarily to FIG. 4, FIG. 12A, FIG. 12B, and FIG. 12D, the first sheet (8) can include at least one first sheet light transmission portion (21) disposed within the first sheet (8), whereby the first sheet light transmission portion (21) communicates between the first sheet front and back surfaces (9)(10). The light (11) provided by the light source (3) to the panel (5) can be transmitted from the panel first surface (6) through the first sheet light transmission portion (21) such that the light (11) can be viewable by a viewer (22) of the first sheet front surface (9).

The first sheet light transmission portion (21) can be formed from a generally transparent material (23), which can allow substantially the entirety of the light (11) from the portion of the panel first surface (6) underlaying the transparent material (23) to be transmitted through the transparent material (23) and, correspondingly, through the first sheet (8), whereby the light (11) can be viewable by a viewer (22) of the first sheet front surface (9).

The first sheet light transmission portion (21) can be formed from a generally translucent material (24), which can allow a portion of the light (11) from the portion of the panel first surface (6) underlaying the translucent material (24) to be transmitted through the translucent material (24) and, correspondingly, through the first sheet (8), whereby the light (11) can be viewable by a viewer (22) of the first sheet front surface (9).

Again referring primarily to FIG. 4, FIG. 12A, FIG. 12B, and FIG. 12D, the first sheet light transmission portion (21) can be configured as an aperture element (25) defining an aperture element opening (26) communicating between the first sheet front and back surfaces (9)(10). The aperture element opening (26) can allow a portion of the light (11) from the portion of the panel first surface (6) underlaying the aperture element opening (26) to be transmitted through the aperture element opening (26) and, correspondingly, through the first sheet (8), whereby the light (11) can be viewable by a viewer (22) of the first sheet front surface (9).

Again referring primarily to FIG. 4, FIG. 12A, FIG. 12B, and FIG. 12D, the aperture element (25) can define an aperture element opening (26) have any of a numerous and wide variety of configurations, depending upon the application. As an illustrative example, the aperture element (25) can define an aperture element opening (26) configured as an alphabetical character (27), a numerical character (28), an image (29), or the like. However, the invention need not be so limited, as the aperture element (25) can define an aperture element opening (26) having any configuration which may be useful for conveying a lesson, story, or the like, described within one or more pages (2) of the illuminated assembly (1).

The first sheet (8), within which the one or more first sheet light transmission portions (21) are disposed, can be formed from a numerous and wide variety of materials, as described above, depending upon the application. As an illustrative example, the first sheet (8) can be formed from a generally opaque paper or paper-like material which precludes light transmission. Accordingly, the light (11) provided by the light source (3) can only be transmitted through portions of the first sheet (8) having one or more first sheet light transmission portions (21).

Again referring primarily to FIG. 4, FIG. 12A, FIG. 12B, and FIG. 12D, as to particular embodiments, indicia (30), such as alphabetical characters (27), numerical characters (28), images (29), or the like, can be viewable through the first sheet light transmission portion (21). As an illustrative example, indicia (30) can be disposed on the panel first surface (6), for example by printing or etching, whereby the indicia (30) can be viewable through the first sheet light transmission portion (21) overlaying the indicia (30). As an additional illustrative example, indicia (30) can be disposed on a second sheet back surface (31) of a second sheet (32) having the second sheet back surface (31) coupled to the panel second surface (7), for example by printing or etching, whereby the indicia (30) can be viewable through both the first sheet light transmission portion (21) and the portion of the panel (5) overlaying the indicia (30). As to particular embodiments, the indicia (30) can be formed from illuminating ink, such fluorescent ink, luminescent ink, phosphorescent ink, or the like.

Again referring primarily to FIG. 4, FIG. 12A, FIG. 12B, and FIG. 12D, the first sheet (8) can further include one or more indicia (30), such as alphabetical characters (27), numerical characters (28), images (29), or the like, disposed on the first sheet front surface (9), for example by printing or etching. As to particular embodiments, the indicia (30) can be formed from illuminating ink, such fluorescent ink, luminescent ink, phosphorescent ink, or the like.

Figure 13A:
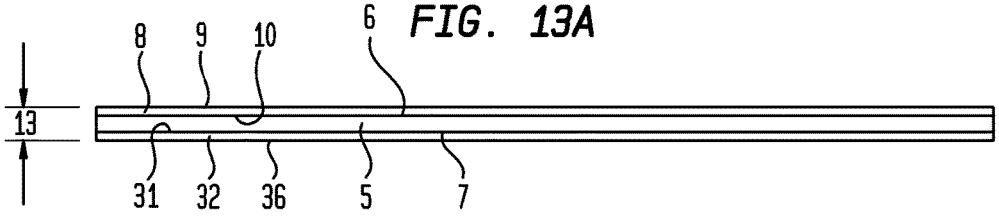
FIG. 13A is a view of a particular embodiment of a page which can be included in the inventive illuminated assembly.
Figure 13B:
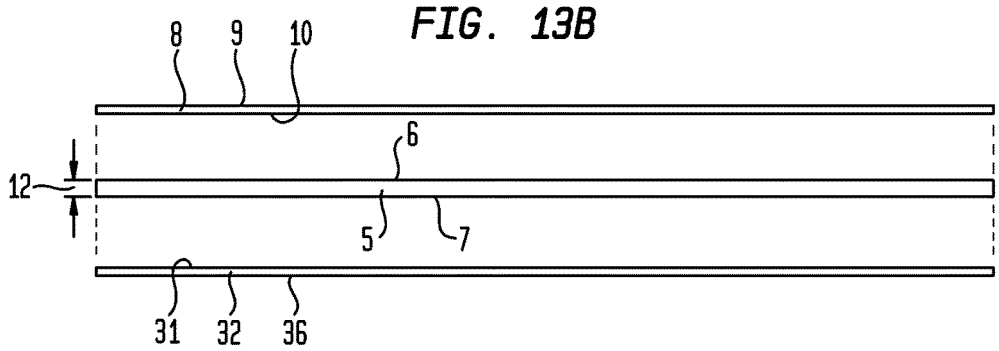
FIG. 13B is an exploded view of the particular embodiment of the page which can be included in the inventive illuminated assembly shown in FIG. 13A.
Figure 13C:
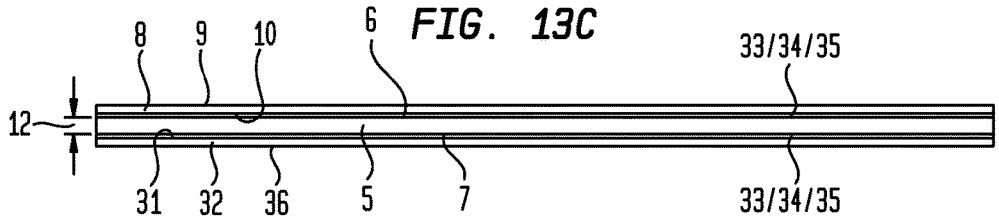
FIG. 13C is a view of a particular embodiment of a page which can be included in the inventive illuminated assembly.
Figure 13D:
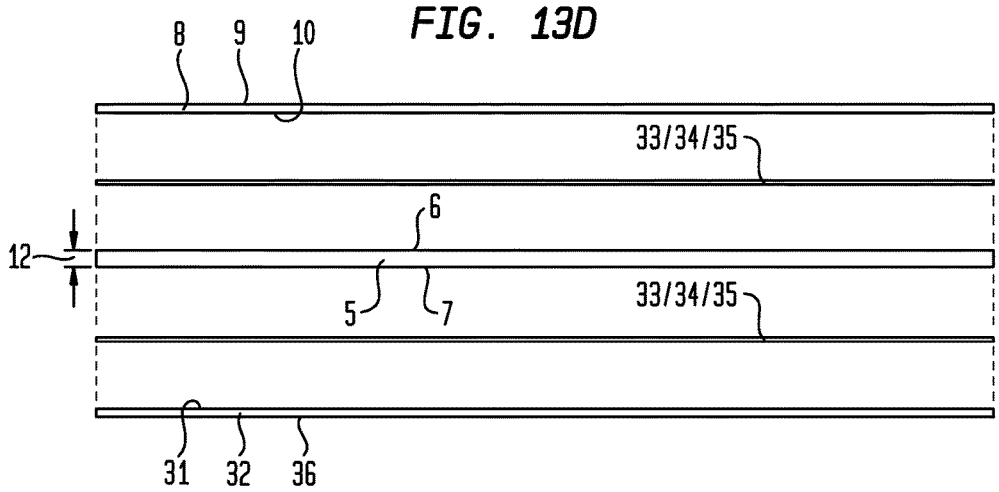
FIG. 13D is an exploded view of the particular embodiment of the page which can be included in the inventive illuminated assembly shown in FIG. 13C.

Now referring primarily to FIG. 13C and FIG. 13D, as to particular embodiments, the illuminated assembly (1) can further include a light altering element (33) disposed between the first sheet back surface (10) and the panel first surface (6). The light altering element (33) can be configured to alter the light (11) transmitted from the panel first surface (6) through the first sheet light transmission portion (21) such that the light (11) viewable by a viewer of the first sheet front surface (9) is altered in relation to the light (11) between the panel first surface (6) and the light altering element (33). As an illustrative example, the light altering element (33) can be formed from a colored translucent material (34), whereby the light (11) transmitted through the colored translucent material (34) and the first sheet light transmission portion (21) can appear to be the color of the colored translucent material (34) when viewed by a viewer (22) of the first sheet front surface (9).

Again referring primarily to FIG. 13C and FIG. 13D, as to particular embodiments, the illuminated assembly (1) can further include a protective element (35), which can be configured to protect the panel first surface (6) from damage, such as damage capable of altering the illumination of the panel first surface (6). As to particular embodiments, the protective element (35) can be disposed between the first sheet back surface (10) and the panel first surface (6). As to other particular embodiments, the protective element (35) can overlay the first sheet front surface (9).

Now referring primarily to FIG. 11 and FIG. 13A through FIG. 13D, as to particular embodiments, a page (2) of the illuminated assembly (1) can further include a second sheet (32) having a second sheet front surface (36) opposite a second sheet back surface (31). The second sheet back surface (31) can be coupled to the panel second surface (7); accordingly, the second sheet (32) can be in overlapping engagement with the panel second surface (7). As such, the panel (5) can be disposed between the first and second sheets (8)(32). The panel (5) can further be coupled to the light source (3), whereby the light source (3) in the activated condition (4) can provide light (11) to the panel first and second surfaces (6)(7), thereby illuminating the panel first and second surfaces (6)(7). As to particular embodiments, the panel (5) can be configured as a light-diffusing panel (14), as described above, whereby the light-diffusing panel (14) can diffuse the light (11) provided by the light source (3) such that the light (11) generally uniformly illuminates the panel first and second surfaces (6)(7).

The second sheet (32) can be formed from any of a numerous and wide variety of materials, depending upon the application. As illustrative examples, the second sheet (32) can be formed from paper, paper-like materials, plastic, fabric, or the like, or combinations thereof; however, the invention need not be so limited, as the second sheet (32) can be formed from any material which can couple to the panel (5) to provide a page (2) of the illuminated assembly (1).

The second sheet (32) can be coupled to the panel (5) using any of a numerous and wide variety of conventional coupling elements, such as adhesives, mechanical fasteners, or any coupling element or method of coupling which can couple the second sheet back surface (31) to the panel second surface (7).

Now referring primarily to FIG. 5 and FIG. 12B through FIG. 12D, the second sheet (32) can include at least one second sheet light transmission portion (37) disposed within the second sheet (32), whereby the second sheet light transmission portion (37) communicates between the second sheet front and back surfaces (36)(31). The light (11) provided by the light source (3) to the panel (5) can be transmitted from the panel second surface (7) through the second sheet light transmission portion (37) such that the light (11) can be viewable by a viewer (22) of the second sheet front surface (36).

The second sheet light transmission portion (37) can be formed from a generally transparent material (23), which can allow substantially the entirety of the light (11) from the portion of the panel second surface (7) underlaying the transparent material (23) to be transmitted through the transparent material (23) and, correspondingly, through the second sheet (32), whereby the light (11) can be viewable by a viewer (22) of the second sheet front surface (36).

The second sheet light transmission portion (37) can be formed from a generally translucent material (24), which can allow a portion of the light (11) from the portion of the panel second surface (7) underlaying the translucent material (24) to be transmitted through the translucent material (24) and, correspondingly, through the second sheet (32), whereby the light (11) can be viewable by a viewer (22) of the second sheet front surface (36).

Again referring primarily to FIG. 5 and FIG. 12B through FIG. 12D, the second sheet light transmission portion (37) can be configured as an aperture element (25) defining an aperture element opening (26) communicating between the second sheet front and back surfaces (36)(31). The aperture element opening (26) can allow a portion of the light (11) from the portion of the panel second surface (7) underlaying the aperture element opening (26) to be transmitted through the aperture element opening (26) and, correspondingly, through the second sheet (32), whereby the light (11) can be viewable by a viewer (22) of the second sheet front surface (36).

Again referring primarily to FIG. 5 and FIG. 12B through FIG. 12D, the aperture element (25) can define an aperture element opening (26) have any of a numerous and wide variety of configurations, depending upon the application. As an illustrative example, the aperture element (25) can define an aperture element opening (26) configured as an alphabetical character (27), a numerical character (28), an image (29), or the like. However, the invention need not be so limited, as the aperture element (25) can define an aperture element opening (26) having any configuration which may be useful for conveying a lesson, story, or the like, described within one or more pages (2) of the illuminated assembly (1).

The second sheet (32), within which the one or more second sheet light transmission portions (37) are disposed, can be formed from a numerous and wide variety of materials, as described above, depending upon the application. As an illustrative example, the second sheet (32) can be formed from a generally opaque paper or paper-like material which precludes light transmission. Accordingly, the light (11) provided by the light source (3) can only be transmitted through portions of the second sheet (32) having one or more second sheet light transmission portions (37).

Again referring primarily to FIG. 5 and FIG. 12B through FIG. 12D, as to particular embodiments, indicia (30), such as alphabetical characters (27), numerical characters (28), images (29), or the like, can be viewable through the second sheet light transmission portion (37). As an illustrative example, indicia (30) can be disposed on the panel second surface (7), for example by printing or etching, whereby the indicia (30) can be viewable through the second sheet light transmission portion (37) overlaying the indicia (30). As an additional illustrative example, indicia (30) can be disposed on the first sheet back surface (10), for example by printing or etching, whereby the indicia (30) can be viewable through both the second sheet light transmission portion (37) and the portion of the panel (5) overlaying the indicia (30). As to particular embodiments, the indicia (30) can be formed from illuminating ink, such fluorescent ink, luminescent ink, phosphorescent ink, or the like.

Again referring primarily to FIG. 5 and FIG. 12B through FIG. 12D, the second sheet (32) can further include one or more indicia (30), such as alphabetical characters (27), numerical characters (28), images (29), or the like, disposed on the second sheet front surface (36), for example by printing or etching. As to particular embodiments, the indicia (30) can be formed from illuminating ink, such fluorescent ink, luminescent ink, phosphorescent ink, or the like.

Now referring primarily to FIG. 13C and FIG. 13D, the illuminated assembly (1) can further include a light altering element (33) disposed between the second sheet back surface (31) and the panel second surface (7). The light altering element (33) can be configured to alter the light (11) transmitted from the panel second surface (7) through the second sheet light transmission portion (37) such that the light (11) viewable by a viewer of the second sheet front surface (36) is altered in relation to the light (11) between the panel second surface (7) and the light altering element (33). As an illustrative example, the light altering element (33) can be formed from a colored translucent material (34), whereby the light (11) transmitted through the colored translucent material (34) and the second sheet light transmission portion (37) can appear to be the color of the colored translucent material (34) when viewed by a viewer (22) of the second sheet front surface (36).

Now referring primarily to FIG. 13C and FIG. 13D, the illuminated assembly (1) can further include a protective element (35), which can be configured to protect the panel second surface (7) from damage, such as damage capable of altering the illumination of the panel second surface (7). As to particular embodiments, the protective element (35) can be disposed between the second sheet back surface (31) and the panel second surface (7). As to other particular embodiments, the protective element (35) can overlay the second sheet front surface (36).

Figure 11:
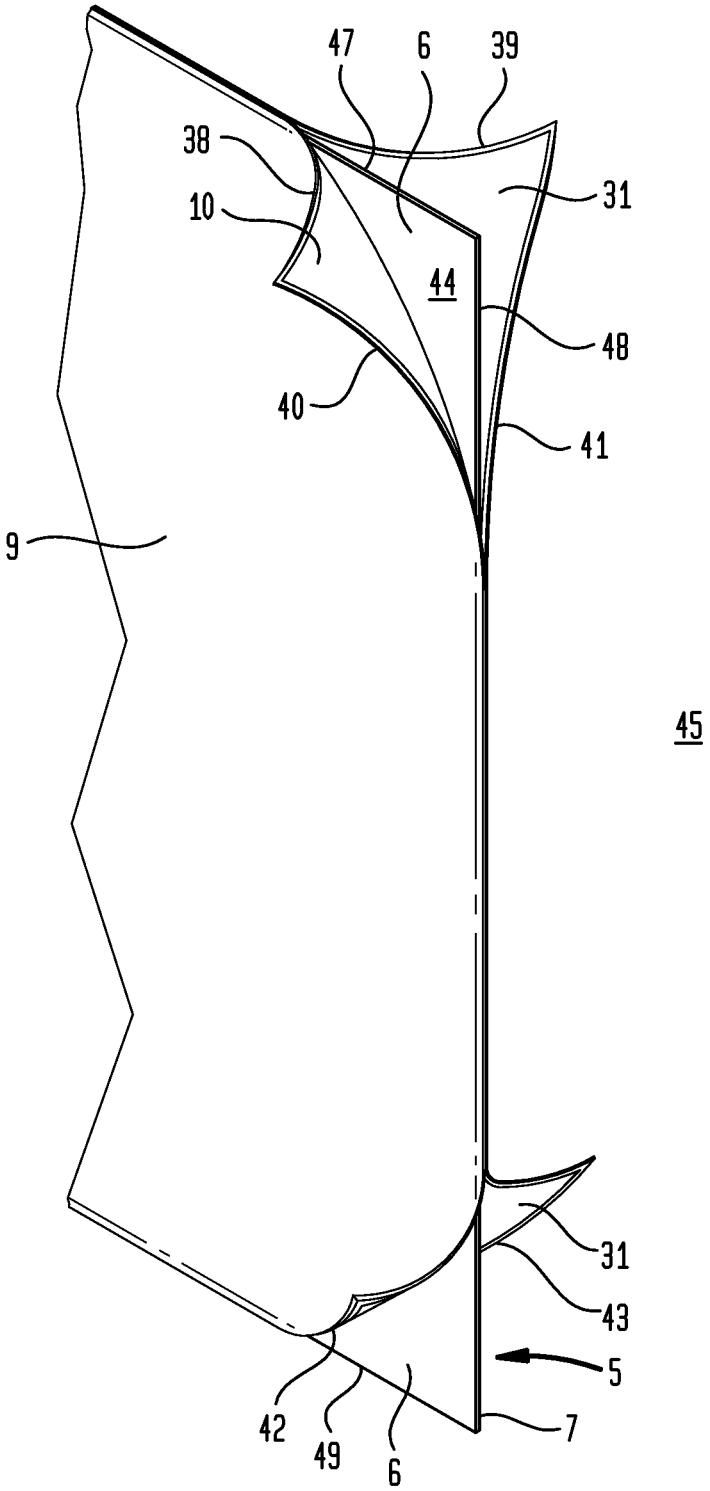
FIG. 11 is a perspective view of a particular embodiment of a page which can be included in the inventive illuminated assembly.
Figure 12A:
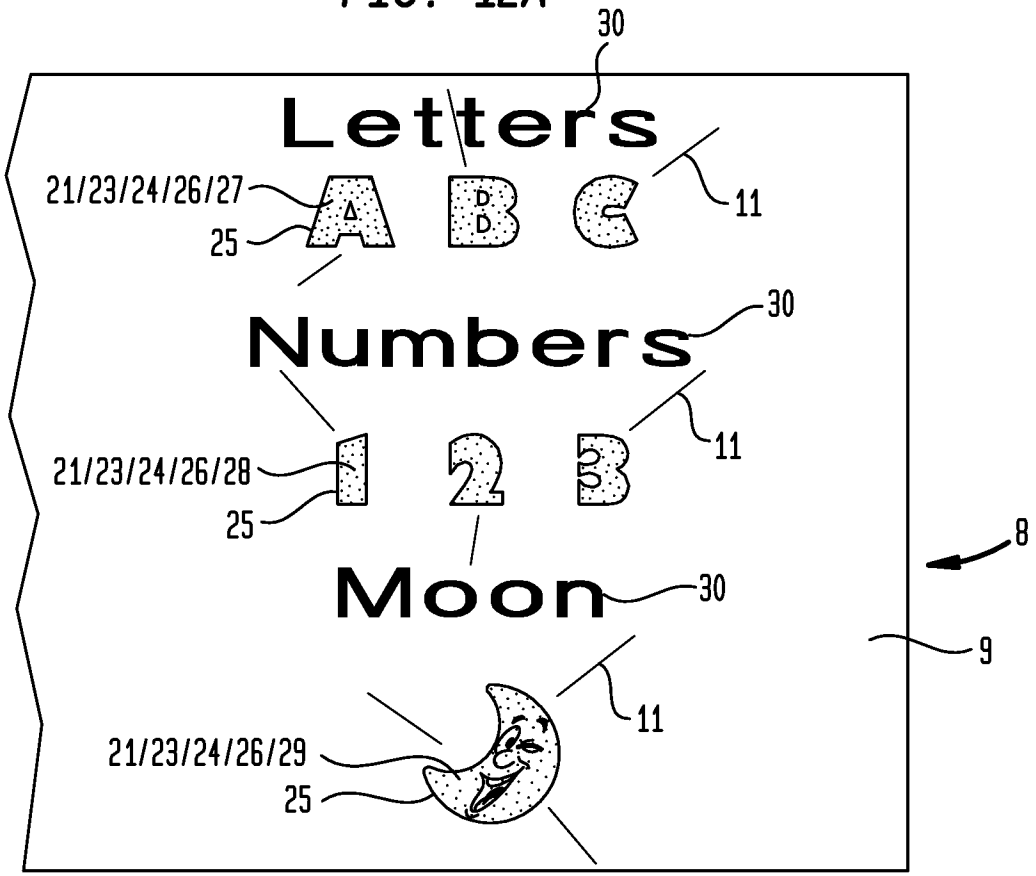
FIG. 12A is a front view of a particular embodiment of a page which can be included in the inventive illuminated assembly.
Figure 12B:
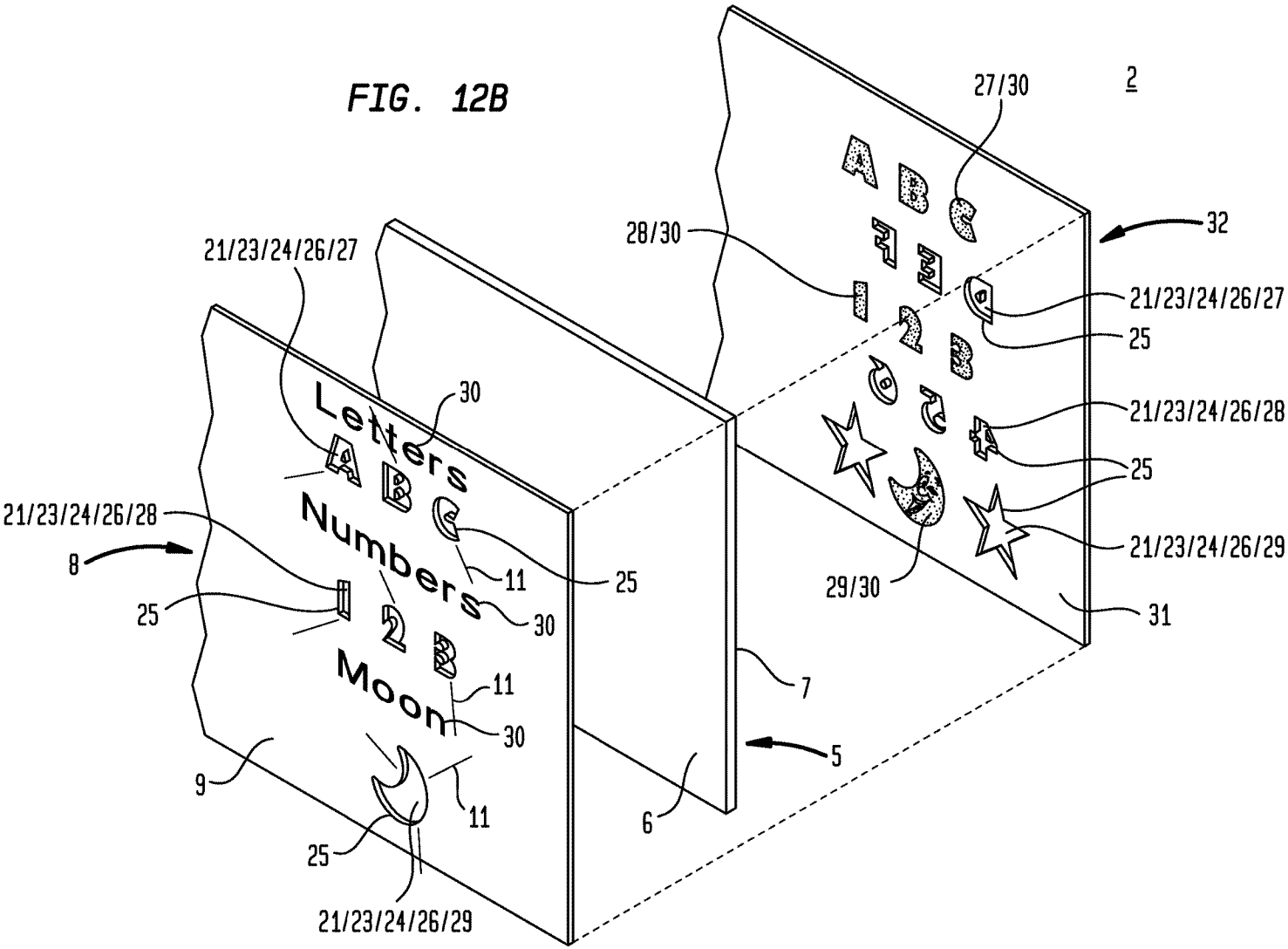
FIG. 12B is an exploded perspective view of the particular embodiment of the page which can be included in the inventive illuminated assembly shown in FIG. 12A.
Figure 12C:
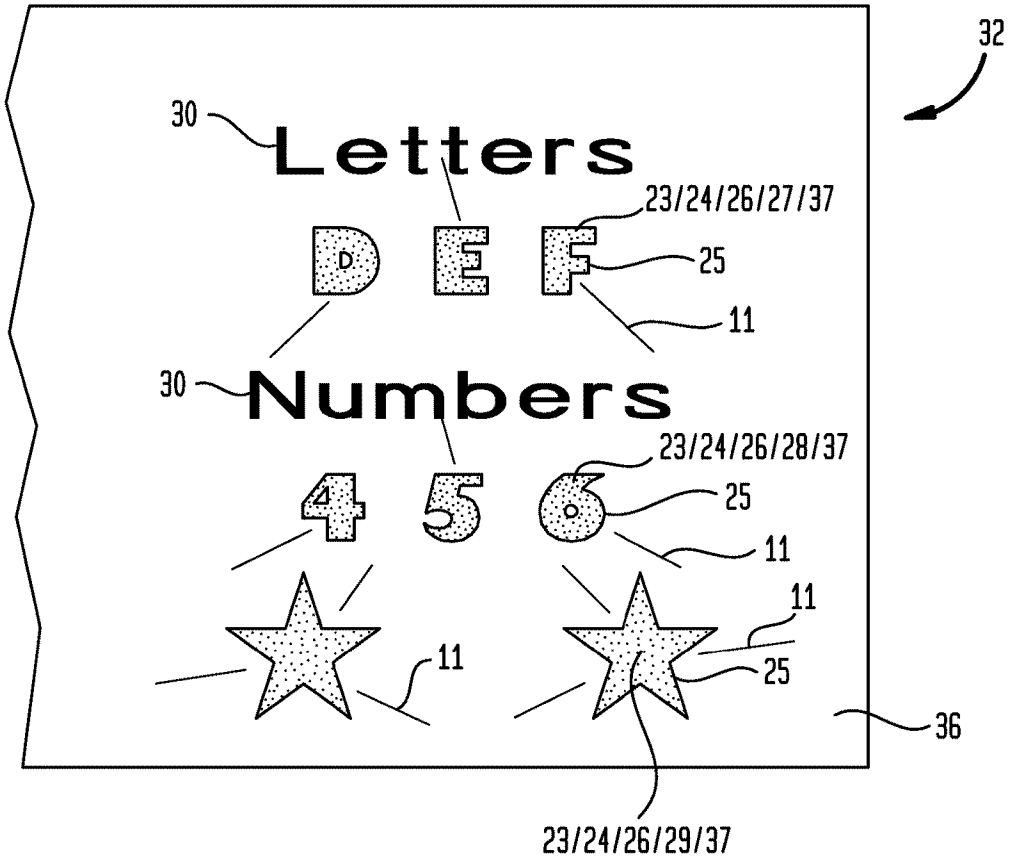
FIG. 12C is a back view of a particular embodiment of a page which can be included in the inventive illuminated assembly.
Figure 12D:
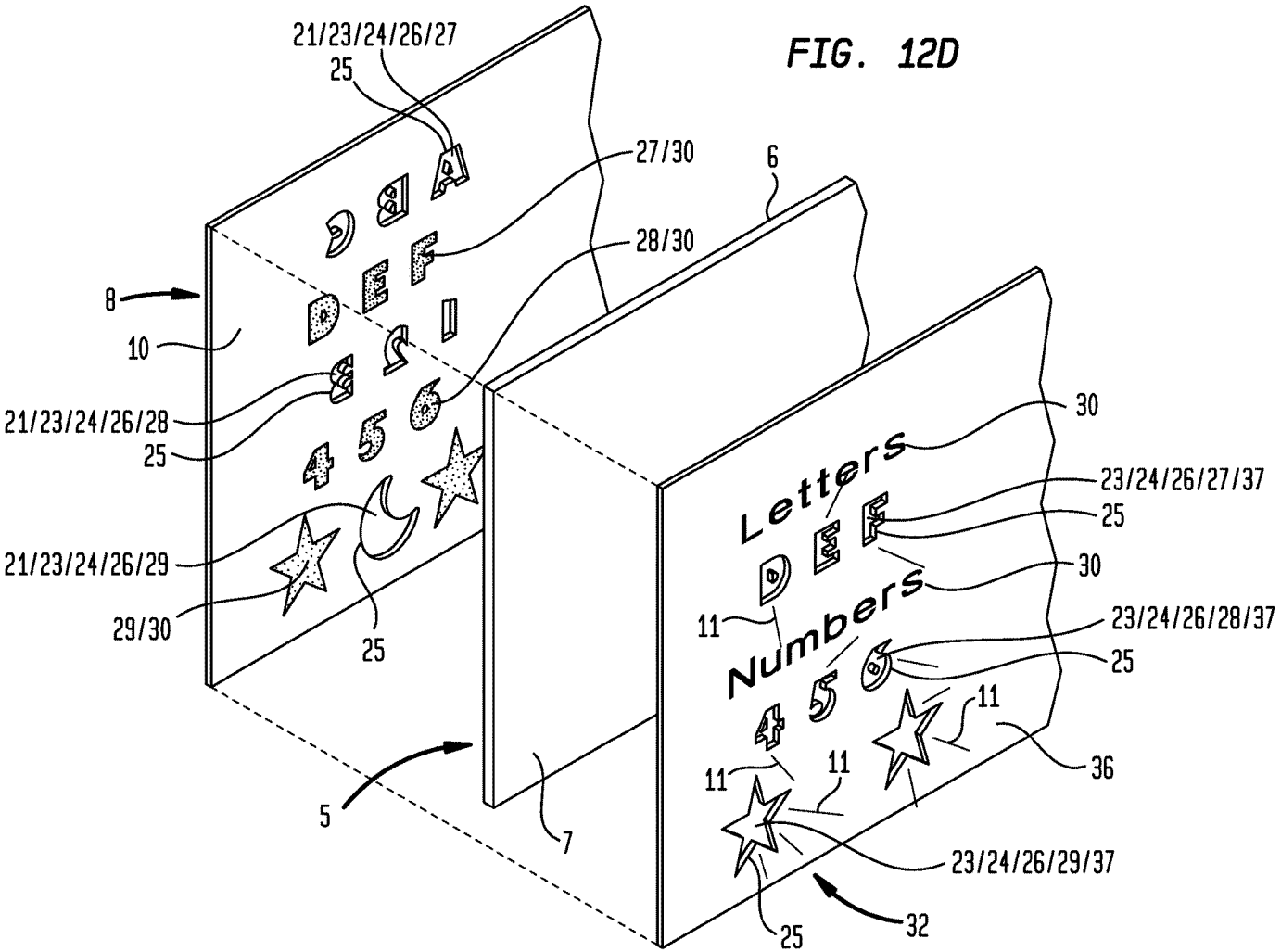
FIG. 12D is an exploded perspective view of the particular embodiment of the page which can be included in the inventive illuminated assembly shown in FIG. 12C.

Now referring primarily to FIG. 11, the first and second sheets (8)(32) can be coupled along corresponding first and second sheet second edges (38)(39), first and second sheet third edges (40)(41), and first and second sheet fourth edges (42)(43) such that the light (11) provided by the light source (3) to the panel (5) proximate the panel first edge (15) is precluded from egressing from an interior space (44) between the first and second sheets (8)(32), which contains the panel (5), to an ambient environment (45). Furthermore, the panel (5) can include a reflective element (46) coupled along panel second, third, and fourth edges (47)(48)(49) (as shown in the example of FIG. 10E) to preclude the light (11) provided by the light source (3) to the panel (5) proximate the panel first edge (15) from egressing from the panel second, third, and fourth edges (47)(48)(49) to the interior space (44) surrounding the panel (5) or to the ambient environment (45).

Figure 3A:
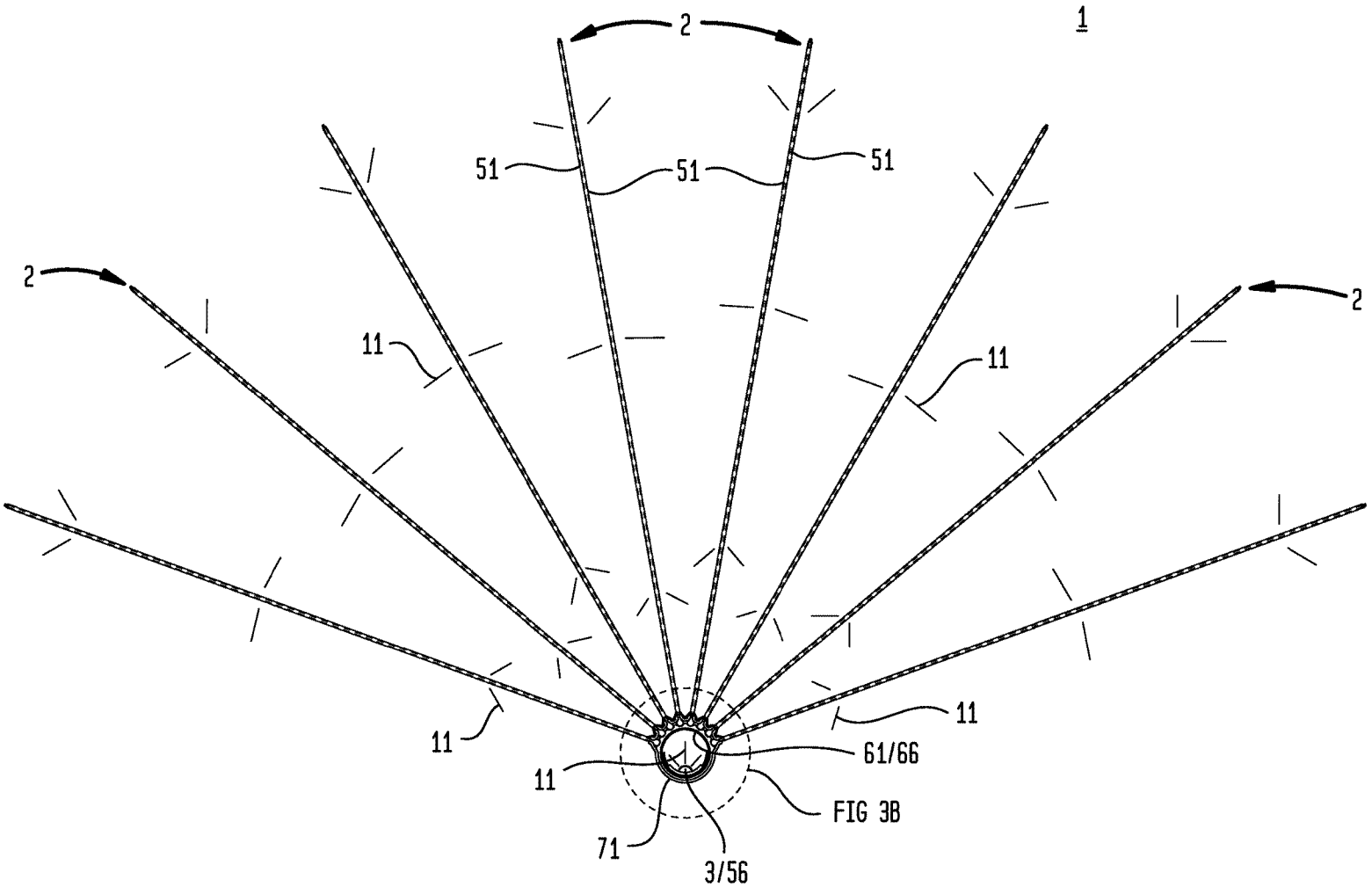
FIG. 3A is a cross-sectional view of the particular embodiment of the inventive illuminated assembly shown in FIG. 2.
Figure 3B:
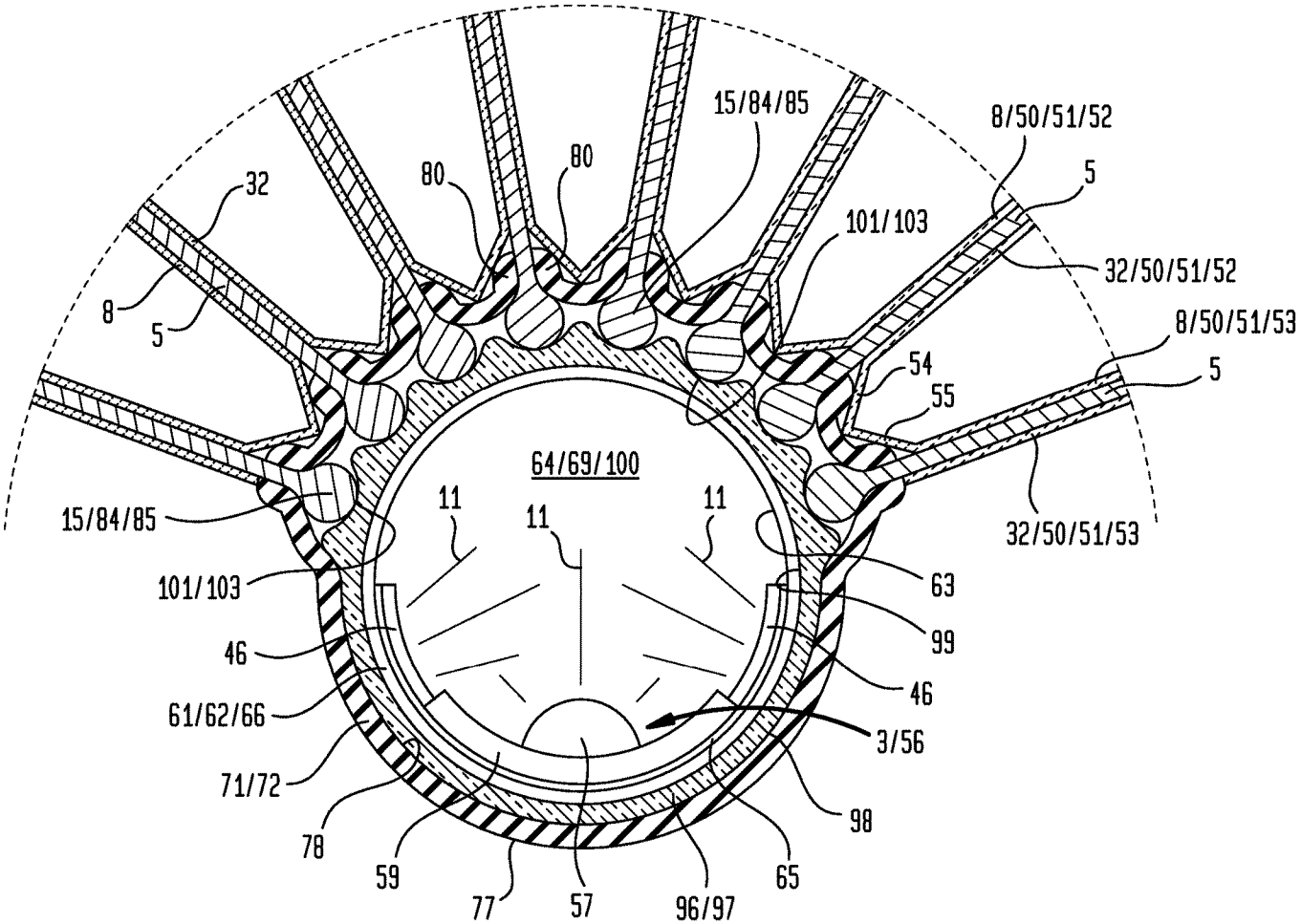
FIG. 3B is an enlarged cross-sectional view of the particular embodiment of the inventive illuminated assembly shown in FIG. 3A.
Figure 4:
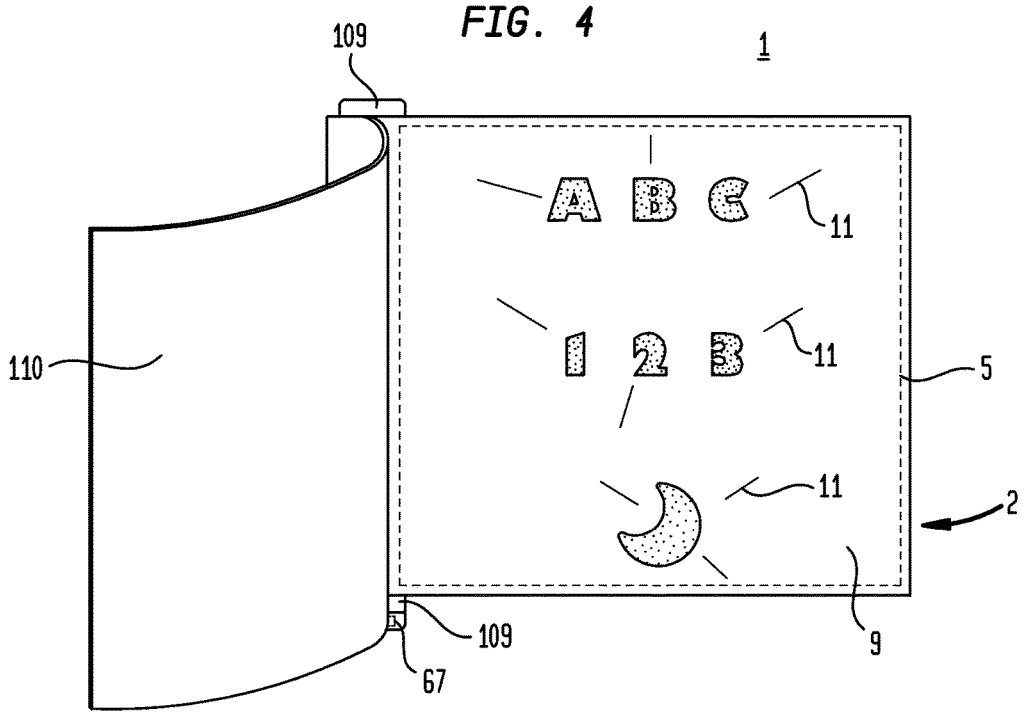
FIG. 4 is a front view of a particular embodiment of the inventive illuminated assembly.
Figure 5:
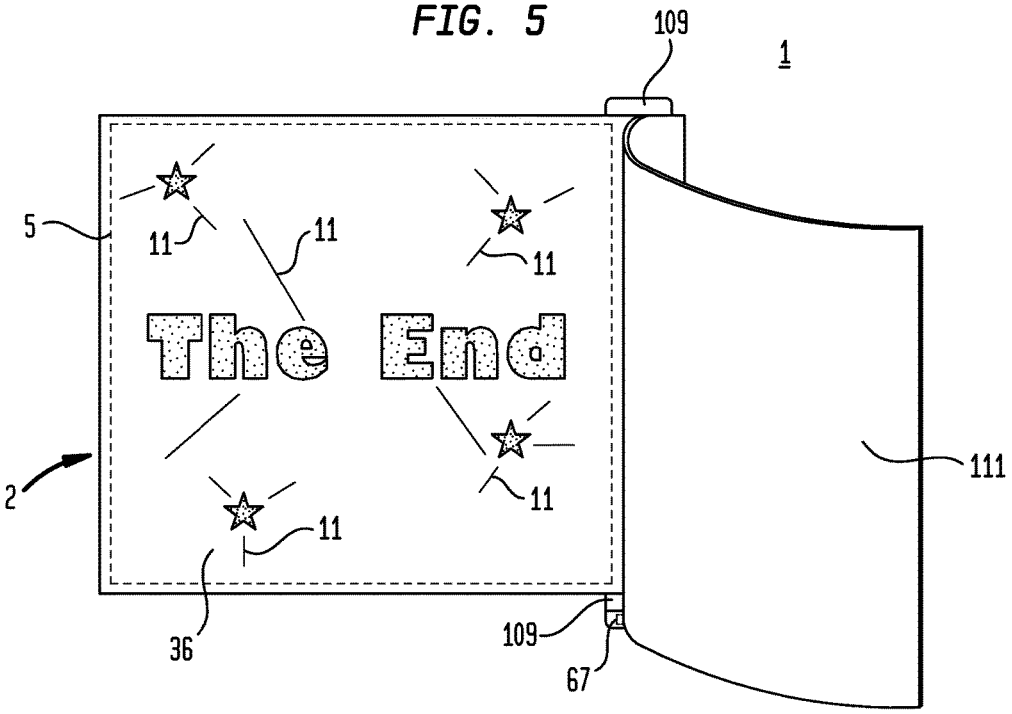
FIG. 5 is a back view of a particular embodiment of the inventive illuminated assembly.
Figure 6:
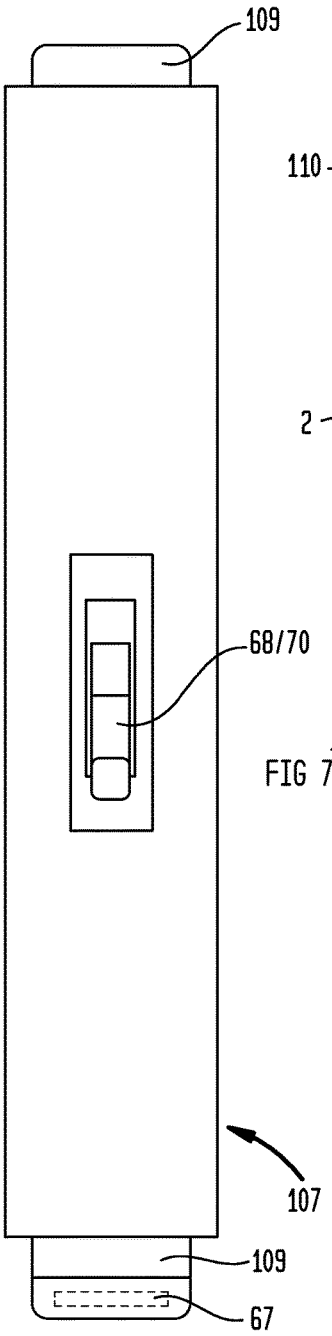
FIG. 6 is a first end view of a particular embodiment of the inventive illuminated assembly.
Figure 7A:
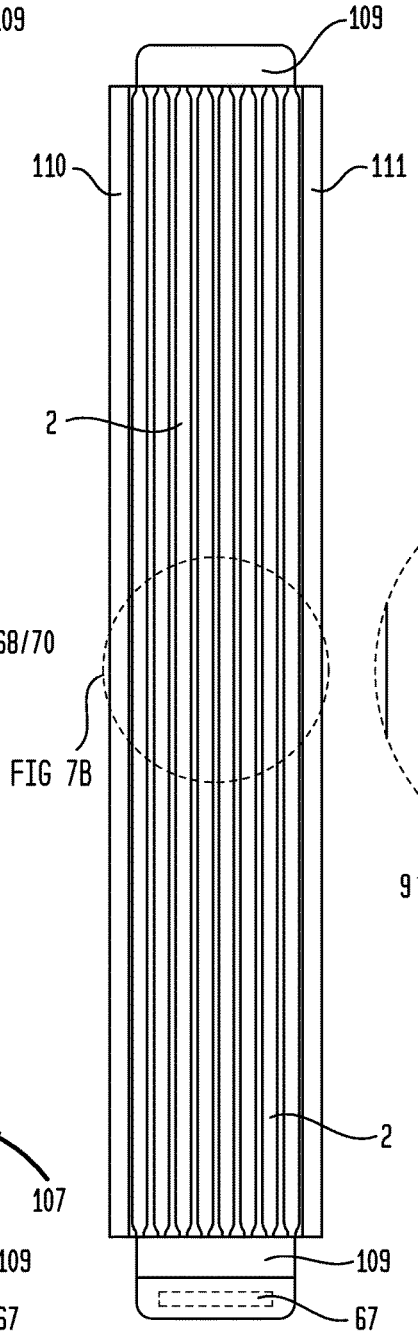
FIG. 7A is a second end view of a particular embodiment of the inventive illuminated assembly.
Figure 7B:
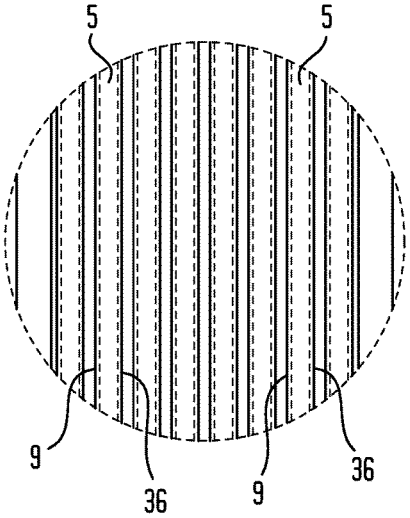
FIG. 7B is an enlarged view of the particular embodiment of the inventive illuminated assembly shown in FIG. 7A.
Figures 8A, 8B, 9A, 9B:
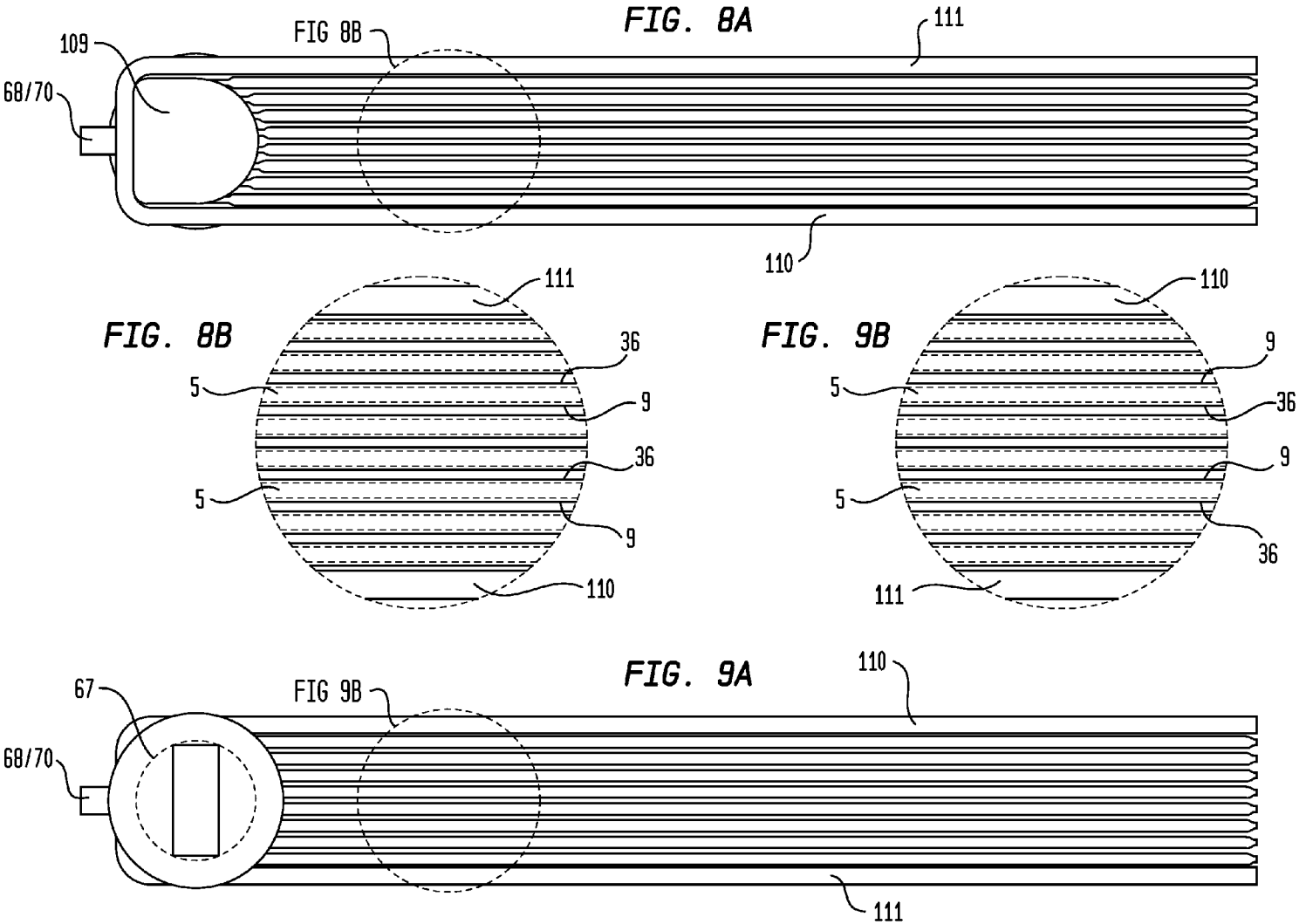
FIG. 8A is a first side view of a particular embodiment of the inventive illuminated assembly.
FIG. 8B is an enlarged view of the particular embodiment of the inventive illuminated assembly shown in FIG. 8A.
FIG. 9A is a second side view of a particular embodiment of the inventive illuminated assembly.
FIG. 9B is an enlarged view of the particular embodiment of the inventive illuminated assembly shown in FIG. 9A.

Now referring primarily to FIG. 3A and FIG. 3B, as to particular embodiments having a plurality of pages (2) and, accordingly, a plurality of panels (5) whereby each panel (5) disposes between a pair of first and second sheets (50), a plurality of pairs of first and second sheets (50) can be coupled to one another to provide a bellowed member (51). To form the bellowed member (51), a second sheet (32) of a first pair of first and second sheets (52) can be coupled to a first sheet (8) of a second pair of first and second sheets (53) proximate corresponding second and first sheet first edges (54)(55) such that the light (11) provided by the light source (3) to the panel (5) proximate the panel first edge (15) is precluded from egressing between the coupled second and first sheet first edges (54)(55). In this way, a plurality of pairs of first and second sheets (50) can be coupled to one another to provide an illuminated assembly (1) whereby the light (11) provided by the light source (3) to the panel (5) can only be transmitted through portions of the first and second sheets (8)(32) having corresponding one or more first and second sheet light transmission portions (21)(37) to be viewable by a viewer (22) of the corresponding first and second sheet front surfaces (9)(36).

Figure 16:
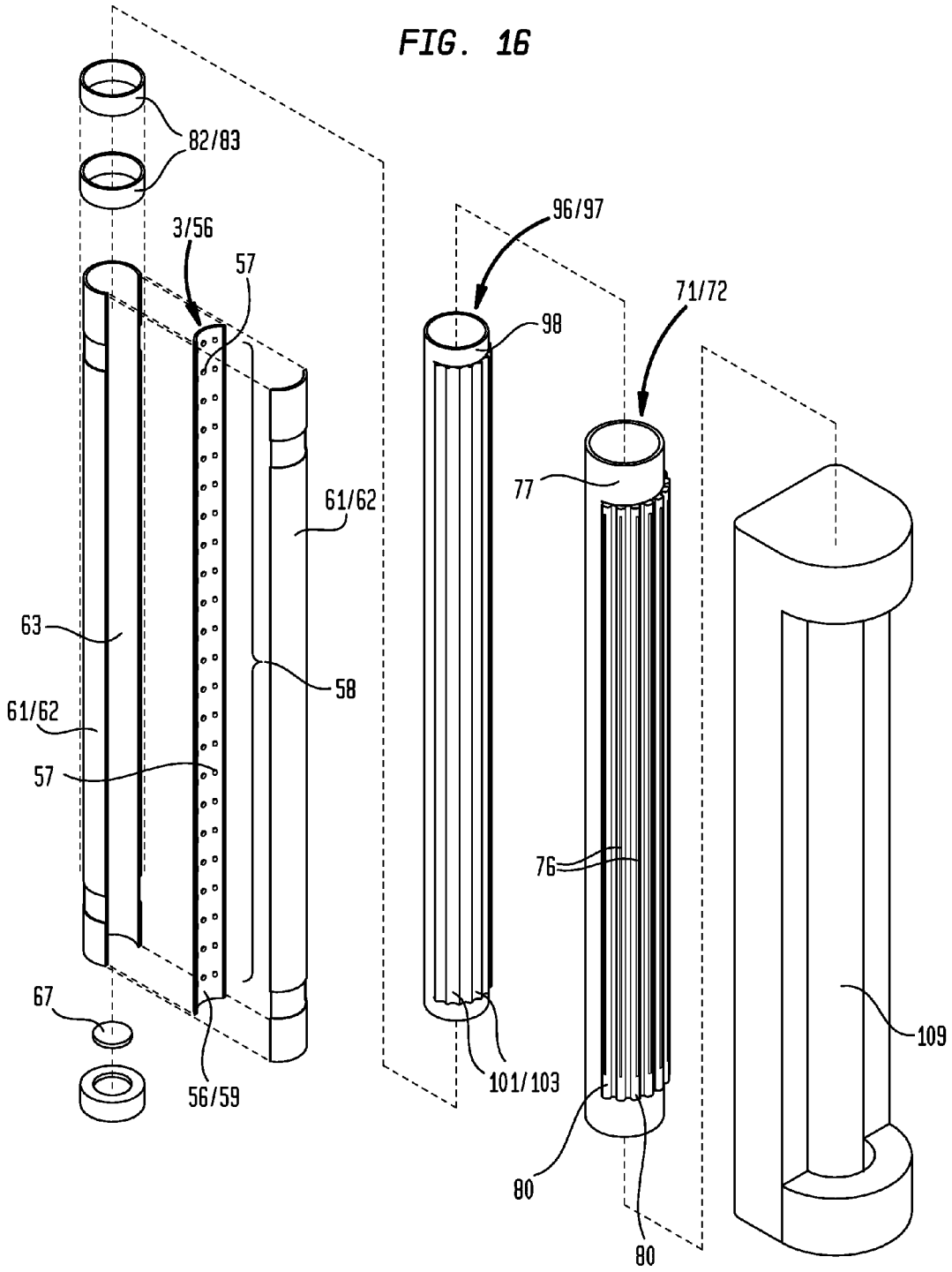
FIG. 16 is an exploded view of a particular embodiment of a light source, light source housing, seating element, coupler, and spine element which can be included in the inventive illuminated assembly.

Now referring primarily to FIG. 3A, FIG. 3B, and FIG. 16, the illuminated assembly (1) can further include a light source (3) operatively coupled to each panel (5) within each page (2) of the plurality of pages (2) included in the illuminated assembly (1). The light source (3) in the activated condition (4) can provide light (11) to each panel first surface (6) (and, as to particular embodiments, each panel second surface (7)), thereby illuminating each panel first surface (6) (and, as to particular embodiments, each panel second surface (7)). As to particular embodiments, the light source (3) can provide the light (11) to each panel (5) proximate the panel first edge (15).

As to particular embodiments, the light source (3) can be configured as a single light source (3), which operatively couples to the plurality of panels (5) to provide light (11) to each panel first surface (6) (and, as to particular embodiments, each panel second surface (7)), thereby illuminating each panel first surface (6) (and, as to particular embodiments, each panel second surface (7)). As to other particular embodiments, the light source (3) can be configured as a plurality of light sources (3) coupled one each to each panel (5) within each page (2) of the plurality of pages (2) included in the illuminated assembly (1), whereby each light source (3) provides light (11) to each corresponding panel first surface (6) (and, as to particular embodiments, each corresponding panel second surface (7)), thereby illuminating each corresponding panel first surface (6) (and, as to particular embodiments, each corresponding panel second surface (7)).

The light source (3) can be configured as any conventional light source (3) capable of providing light (11) to each panel (3), for example by providing light (11) to each panel (5) proximate the panel first edge (15). As illustrative examples, the light source (3) can include a light-emitting diode (LED) light source (56), an incandescent light source, a fluorescent light source, an electroluminescent light source, a bioluminescent light source, a chemiluminescent light source, a phosphorescent light source, an ultraviolet light source, or the like, or combinations thereof.

Again referring primarily to FIG. 3A, FIG. 3B, and FIG. 16, as to particular embodiments, the light source (3) can include an LED light source (56) having one or more LEDs (57). As to particular embodiments, the LED light source (56) can be configured as a plurality of LEDs (57) mounted in one or more linear arrays (58) on a rigid or flexible strip (59). The LEDs (57) can be configured as side-emitting LEDs, top-emitting LEDs, or combinations thereof. As an illustrative example, the LED light source (56) can be configured as a rigid or flexible strip (59) having a plurality of linear arrays (58) of top-emitting LEDs (57), whereby the rigid or flexible strip (59) can operatively couple to each panel (5) such that the top-emitting LEDs (57) orient to provide light (11) to each panel (5) proximate each panel first edge (15).

As to other particular embodiments, the LED light source (56) can be configured as a pair of LEDs (57) coupled one each proximate panel first edge opposing ends (60), whereby the pair of LEDs (57) can provide light (11) to each panel (5) proximate each panel first edge (15) along generally the entirety of each panel first edge (15).

Now referring primarily to FIG. 3B, the light source (3) can be coupled to a reflective element (46), whereby the reflective element (46) can reflect the light (11) provided by the light source (3). As to particular embodiments, the reflective element (46) can reflect the light (11) provided by the light source (3) such that the light (11) is provided to each panel (5) proximate each panel first edge (15). As an illustrative example, the reflective element (46) can be configured as a reflective surface including a metal such as aluminum, chrome, gold, nickel, silver, steel, or the like, or combinations thereof. As an additional illustrative example, the reflective surface can be formed from a high diffuse reflective film, which can include, as a non-limiting example, White97™ Film or White98™ Film, obtainable from WhiteOptics LLC, 246-G Quigley Boulevard, New Castle, Del. 19720, USA.

Figure 14A:
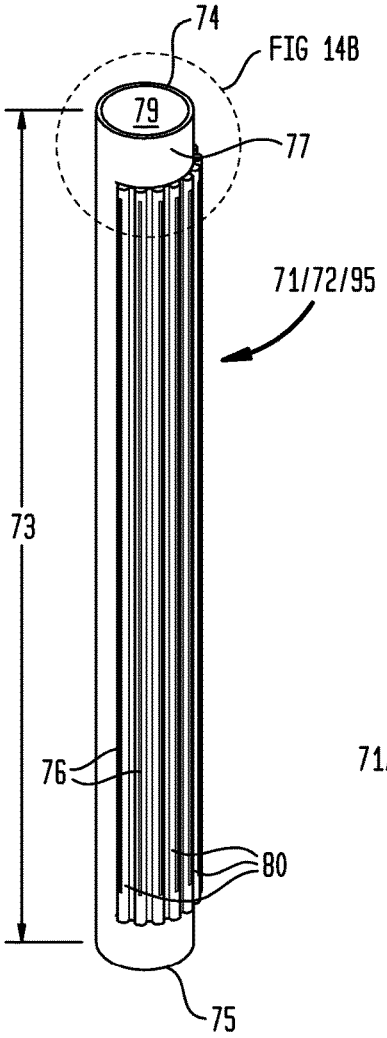
FIG. 14A is a perspective view of a particular embodiment of a coupler which can be included in the inventive illuminated assembly.
Figure 14B:
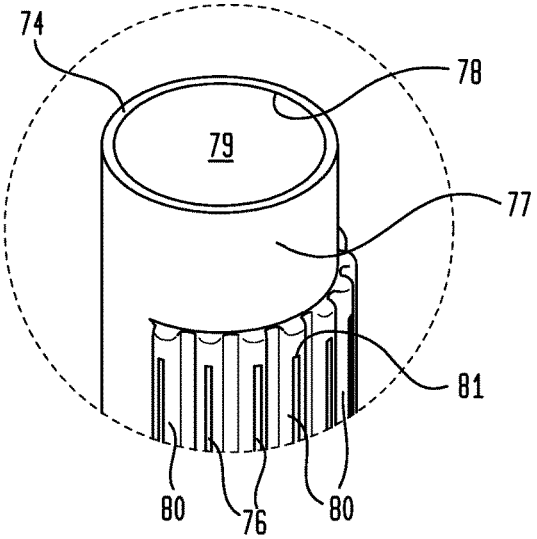
FIG. 14B is an enlarged view of the particular embodiment of the coupler which can be included in the inventive illuminated assembly shown in FIG. 14A.
Figure 14C:
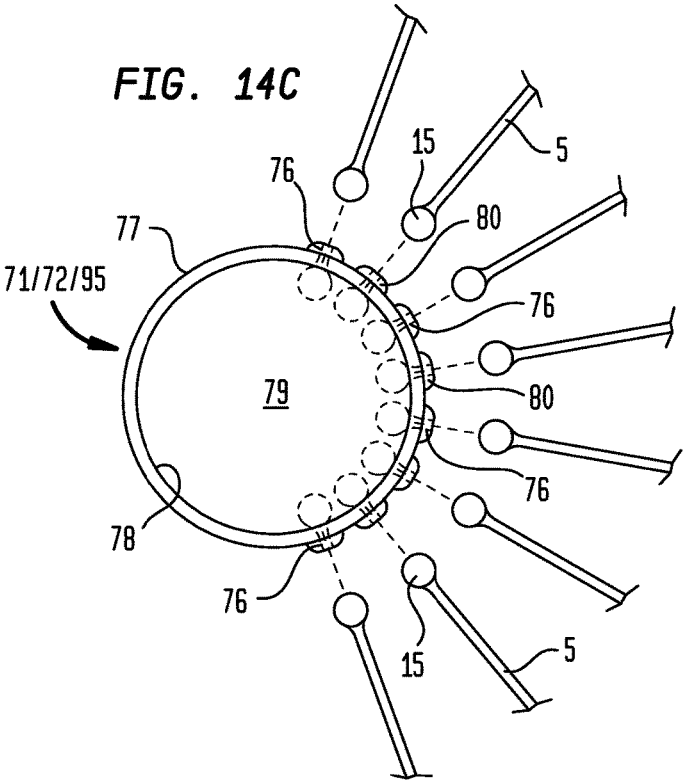
FIG. 14C is a side view of a particular embodiment of a coupler which can be included in the inventive illuminated assembly, whereby a plurality of panels are shown exploded out of a corresponding plurality of elongate slots of the coupler.
Figure 15A:
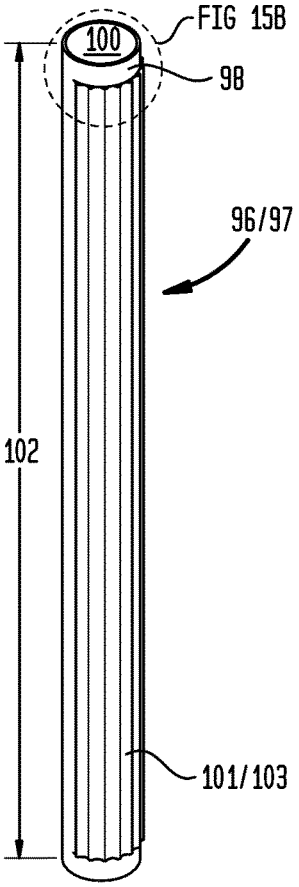
FIG. 15A is a perspective view of a particular embodiment of a seating element which can be included in the inventive illuminated assembly.
Figure 15B:
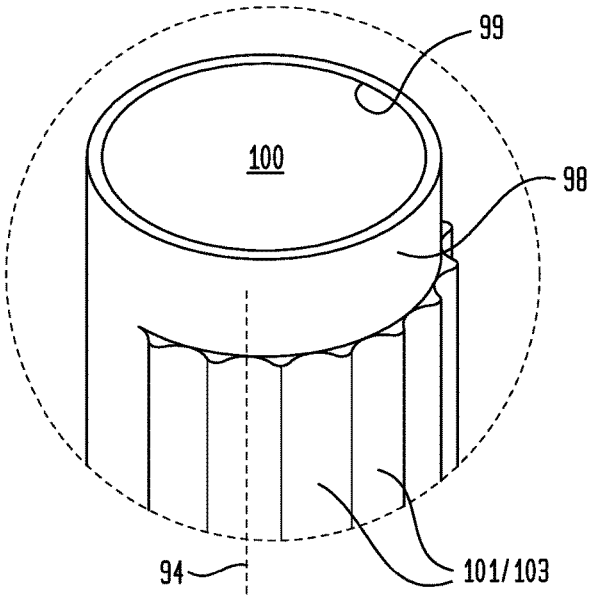
FIG. 15B is an enlarged view of the particular embodiment of the seating element which can be included in the inventive illuminated assembly shown in FIG. 15A.
Figure 15C:
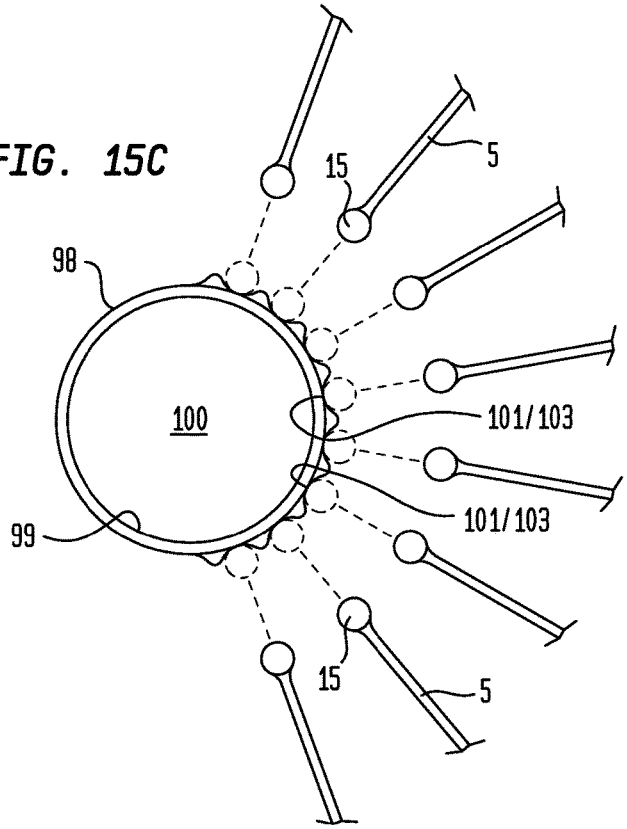
FIG. 15C is a side view of a particular embodiment of a seating element which can be included in the inventive illuminated assembly, whereby a plurality of panels are shown exploded out of a corresponding plurality of elongate seats of the seating element.

Now referring primarily to FIG. 3A, FIG. 3B, and FIG. 14, the illuminated assembly (1) can further include a light source housing (61) configured to house the light source (3). As to particular embodiments, the light source housing (61) can be configured to couple the light source (3) to each panel (5), for example such that the light source (3) can provide the light (11) proximate each panel first edge (15). As an illustrative example, the light source housing (61) can be configured as a light source housing tubular member (62) having a light source housing tubular member internal surface (63) bounding a light source housing tubular member interior space (64), whereby the light source (3) can be received within the light source housing tubular member interior space (64). As to particular embodiments, the light source (3) can be coupled to the light source housing tubular member internal surface (63), for example by an adherent layer (65) which functions to adhere the light source (3) to the light source housing tubular member internal surface (63) or by one or more mechanical fasteners which function to fasten the light source (3) to the light source housing tubular member (62) proximate the light source housing tubular member internal surface (63). As an illustrative example, an LED light source (56) configured as a flexible strip (59) having a plurality of linear arrays (58) of top-emitting LEDs (57) can be coupled to the light source housing tubular member internal surface (63) by an adherent layer (65), whereby the flexible strip (59) can operatively couple to each panel (5) such that the top-emitting LEDs (57) orient to provide light (11) to each panel (5) proximate each panel first edge (15).

Now referring primarily to FIG. 3B, as to particular embodiments, a reflective element (46), as described above, can be coupled to the light source housing tubular member internal surface (63) to reflect the light (11) provided by the light source (3) within the light source housing tubular member interior space (64). As such, the light (11) provided by the light source (3) can illuminate generally the entirety of the light source housing tubular member interior space (64) and accordingly, can illuminate generally the entirety of each panel first edge (15) operatively coupled to the light source (3) and disposed proximate the light source housing tubular member interior space (64).

As to particular embodiments, the light source housing (61) can removably couple to the plurality of panels (5). As to particular embodiments, the light source housing (61) can slidably engage with the plurality of panels (5) whereby, in an engaged condition (66), the light source (3) can provide light (11) to each panel (5) proximate each panel first edge (15).

Now referring primarily to FIG. 2, FIG. 4 through FIG. 6, FIG. 7A, FIG. 9A, and FIG. 16, the illuminated assembly (1) can further include a power source (67) operatively coupled to the light source (3) to generate the activated condition (4), whereby the light source (3) can provide light (11) to each panel (5). The power source (67) can include any of a wide variety of power sources (67) capable of powering the light source (3). As an illustrative example, the power source (67) can be configured as a battery, whether a non-rechargeable battery or a rechargeable battery.

Now referring primarily to FIG. 2, FIG. 6, FIG. 8A, and FIG. 9A, the illuminated assembly (1) can further include an actuator (68) coupled to the power source (67) and the light source (3). The actuator (68) can function to electrically couple the power source (67) and the light source (3) to generate the activated condition (4) of the light source (3), whereby the light source (3) can provide light (11) to each panel (5). Additionally, the actuator (68) can function to electrically uncouple the power source (67) and the light source (6) to generate a deactivated condition of the light source (3), whereby the light source (3) does not provide light (11) to the plurality of panels (5). As an illustrative example, the actuator (68) can be configured as a conventional on/off switch (70), which can electrically couple and uncouple the power source (67) and the light source (3). Accordingly, when a viewer (22) desires to illuminate one or more pages (2) of the illuminated assembly (1), the viewer (22) can manually switch the on/off switch (70) to an on position, thereby electrically coupling the power source (67) and the light source (3) to generate the activated condition (4) of the light source (3), whereby the light source (3) can provide light (11) to each panel (5). Conversely, a viewer (22) can electrically uncouple the power source (67) and the light source (3) by manually switching the on/off switch (70) to an off position to generate the deactivated condition of the light source (3), whereby the light source (3) does not provide light (11) to the plurality of panels (5).

Now referring primarily to FIG. 3B, FIG. 14A through FIG. 14C, and FIG. 16, the illuminated assembly (1) can further include a coupler (71) configured to couple each panel (5) within each page (2) of the plurality of pages (2) included in the illuminated assembly (1) to the light source (3). As to particular embodiments, the coupler (71) can be configured to couple each panel (5) within each page (2) of the plurality of pages (2) included in the illuminated assembly (1) to the light source (3) such that the light source (3) can provide light (11) proximate each panel first edge (15).

Again referring primarily to FIG. 3B, FIG. 14A through FIG. 14C, and FIG. 16, as to particular embodiments, the coupler (71) can be configured as a coupler tubular member (72) having a coupler tubular member length (73) disposed between coupler tubular member first and second ends (74)(75). The coupler tubular member (72) can include a plurality of elongate slots (76) which communicate between a coupler tubular member external surface (77) and a coupler tubular member internal surface (78), whereby the coupler tubular member internal surface (78) defines a coupler tubular member interior space (79). Each of the elongate slots (76) can extend between the coupler tubular member first and second ends (74)(75) in generally parallel relation to the coupler tubular member length (73). As to particular embodiments, each of the elongate slots (76) can have an elongate sleeve (80) surrounding an elongate slot periphery (81), whereby the elongate sleeve (80) outwardly extends from the coupler tubular member external surface (77).

Each panel (5) can be disposed within a corresponding elongate slot (76) and, as to particular embodiments, a corresponding elongate sleeve (80), such that the panel first edge (15) disposes proximate the coupler tubular member interior space (79) defined by the coupler tubular member internal surface (78). The light source (3) can be received within the coupler tubular member interior space (79) such that the light (11) provided by the light source (3) can illuminate generally the entirety of the coupler tubular member interior space (79). Accordingly, the light (11) provided by the light source (3) can illuminate generally the entirety of each panel first edge (15) of each panel (5) disposed within a corresponding elongate slot (76) whereby each panel first edge (15) disposes proximate the coupler tubular member interior space (79).

As to particular embodiments of the illuminated assembly (1) having the light source (3) housed in the light source housing (61) configured as a light source housing tubular member (62), the light source housing tubular member (62) can removably telescopingly engage within the coupler tubular member interior space (79) such that the light (11) provided by the light source (3) can illuminate generally the entirety of the coupler tubular member interior space (79). Accordingly, the light (11) provided by the light source (3) can illuminate generally the entirety of each panel first edge (15) of each panel (5) disposed within a corresponding elongate slot (76) whereby each panel first edge (15) disposes proximate the coupler tubular member interior space (79). As to particular embodiments, the light source housing tubular member (62) can include one or more securement elements (82), such as an elastomeric annular element (83), which can function to releasably secure the light source housing tubular member (62) within the coupler tubular member interior space (79) by frictional engagement with the coupler tubular member internal surface (78).

Now referring primarily to FIG. 10B through FIG. 10G, each panel first edge (15) can include a panel first edge retaining element (84) configured to retain the panel (5) within a corresponding elongate slot (76) such that the panel first edge (15) disposes proximate the coupler tubular member interior space (79). As to particular embodiments, the panel first edge retaining element (84) can be configured as a panel first edge (15) having dimensional relations sufficiently greater than the dimensional relations of the corresponding elongate slot (76), thereby precluding the panel first edge (15) from passing through the elongate slot (76) from a location proximate the coupler tubular member internal surface (78) toward the coupler tubular member external surface (77).

Again referring primarily to FIG. 10B through FIG. 10G, as an illustrative example, the panel first edge retaining element (84) can be configured as a generally cylindrical panel first edge (85) having a cylinder diameter (86), a cylinder length (87), or both, sufficiently greater than the corresponding elongate slot width or elongate slot length to preclude the generally cylindrical panel first edge (85) from passing through the elongate slot (76) from a location proximate the coupler tubular member internal surface (78) toward the coupler tubular member external surface (77). Accordingly, the panel (5) can be retained within the elongate slot (76) such that the generally cylindrical panel first edge (85) disposes proximate the coupler tubular member interior space (79).

Now referring primarily to FIG. 10F and FIG. 10G, the panel first edge (15), for example a generally cylindrical panel first edge (85), can have a panel first edge external surface (90) configured to increase the amount of light (11) provided by the light source (3) to the panel (5) via the panel first edge (15). As an illustrative example, the panel first edge external surface (90), for example a generally cylindrical panel first edge external surface (91), can be configured as a bellowed surface (92), a dimpled surface (93), or the like, or any surface configuration which increases the surface area of the panel first edge external surface (90), thereby increasing the amount of the light ( ) provided by the light source ( ) to the panel ( ) via the panel first edge (15).

The coupler tubular member (72) can be formed from any of a numerous and wide variety of materials, depending upon the application. As to particular embodiments, the coupler tubular member (72), including each elongate sleeve (80), can be formed from a resiliently flexible material to allow each panel (5) received within a corresponding elongate slot (76) to rotate about a rotational axis (94), which can be in generally parallel relation to the coupler tubular member length (73). As an illustrative example, the coupler tubular member (72) can be formed from an elastomer (95), such as rubber or rubber-like material, for example neoprene rubber, nitrile rubber, latex rubber, silicone rubber, polyurethane, or the like, which can allow each panel (5) received within a corresponding elongate slot (76) to rotate about the rotational axis (94) in a similar fashion to the rotation of pages within a conventional book about a book spine.

As to particular embodiments, the elastomer (95) can be a generally opaque elastomer, such as a black elastomer, which can preclude the light (11) from the light source (3) received within the coupler tubular member interior space (79) from being transmitted through the coupler tubular member (72), thus the light (11) is provided only to the panel first edges (15) of the panels (5) received within the elongate slots (76) of the coupler tubular member (72).

Now referring primarily to FIG. 3B, FIG. 15A through FIG. 15C, and FIG. 16, the illuminated assembly (1) can further include a seating element (96) configured as a seating element tubular member (97) having a seating element tubular member external surface (98) and a seating element tubular member internal surface (99), whereby the seating element tubular member internal surface (99) defines a seating element tubular member interior space (100). A plurality of elongate seats (101) can be coupled to the seating element tubular member external surface (98) in spaced apart relation, whereby the plurality of elongate seats (101) dispose in generally parallel relation to a seating element tubular member length (102).

Again referring primarily to FIG. 3B, FIG. 15A through FIG. 15C, and FIG. 16, a panel first edge (15) can rotatably engage within a corresponding elongate seat (101) such that the panel (5) can rotate about the rotational axis (94) when the panel first edge (15) seats within the corresponding elongate seat (101). As an illustrative example, a generally cylindrical panel first edge (85) can rotatably engage within a generally semi-cylindrical elongate seat (103) such that the panel (5) can rotate about the rotational axis (94) when the generally cylindrical panel first edge (85) seats within the corresponding generally semi-cylindrical elongate seat (103).

Now referring primarily to FIG. 3B and FIG. 16, the seating element tubular member (97) can telescopingly engage within the coupler tubular member interior space (79), disposing the seating element tubular member external surface (98) and associated plurality of elongate seats (101) proximate the coupler tubular member internal surface (78) such that the plurality of elongate seats (101) align with the plurality of elongate slots (76) disposed within the coupler tubular member (72). Accordingly, the panel first edges (15) of the panels (5) received within the elongate slots (76) of the coupler tubular member (72) can be seated within the elongate seats (101) of the seating element tubular member (97).

Now referring primarily to FIG. 16, as to particular embodiments of the illuminated assembly (1) having the light source (3) housed in the light source housing (61) configured as a light source housing tubular member (62), the light source housing tubular member (62) can removably telescopingly engage within the seating element tubular member interior space (100) such that the light (11) provided by the light source (3) can illuminate generally the entirety of the seating element tubular member interior space (100). Additionally, the light (11) can be transmitted through the seating element tubular member (97) and associated plurality of elongate seats (101) to illuminate generally the entirety of the coupler tubular member interior space (79). Accordingly, the light (11) provided by the light source (3) can illuminate generally the entirety of each panel first edge (15) of each panel (5) disposed within a corresponding elongate slot (76) and a corresponding elongate seat (101) whereby each panel first edge (15) disposes proximate the coupler tubular member interior space (79) and within a corresponding elongate seat (101) of the seating element tubular member (97).

The seating element tubular member (97) can be formed from any of a numerous and wide variety of materials, depending upon the application. As to particular embodiments having the light source housing tubular member (62) removably telescopingly engaged within the seating element tubular member interior space (100), the seating element tubular member (97) and associated plurality of elongate seats (101) can be formed from a generally transparent material, which can allow the light (11) provided by the light source (3) to be transmitted from the light source (3) within the light source housing tubular member interior space (64) removably telescopingly engaged within the seating element tubular member interior space (100) through the seating element tubular member (97) and associated plurality of elongate seats (101) to each panel first edge (15) of each panel (5) disposed within a corresponding elongate slot (76) of the coupler tubular member (72). As an illustrative example, the seating element tubular member (97) and associated plurality of elongate seats (101) can be formed from a generally transparent plastic or plastic-like material, such as acrylic, which can allow the light (11) to pass through the seating element tubular member (97) and associated plurality of elongate seats (101).

As to particular embodiments, the light source housing tubular member (62), the coupler tubular member (72), or the seating element tubular member (97) can include end caps configured to cap the opposing ends of the corresponding light source housing tubular member (62), coupler tubular member (72), or seating element tubular member (97) and preclude the light (11) provided by the light source (3) from egressing from the corresponding light source housing tubular member interior space (64), coupler tubular member interior space (79), or seating element tubular member interior space (100) through the corresponding opposing ends of the light source housing tubular member (62), coupler tubular member (72), or seating element tubular member (97) toward the ambient environment (45). Accordingly, the light (11) provided by the light source (3) can only be transmitted to each panel (5) and through corresponding portions of the first and second sheets (8)(32) having corresponding one or more first and second sheet light transmission portions (21)(37) to be viewable by a viewer (22) of the corresponding first and second sheet front surfaces (9)(36).

Now referring primarily to FIG. 2, FIG. 4, FIG. 5, FIG. 6, FIG. 7A, FIG. 8A, FIG. 9A, and FIG. 16, the illuminated assembly (1) can further include a binding assembly (107) which can bind the components of the illuminated assembly (1) together to provide a solitary construct (108). As to particular embodiments, the binding assembly (107) can include a spine element (109) coupled between front and back covers (110)(111), whereby the light source (3) can couple within the spine element (109) to provide light to the plurality of pages (2) of the illuminated assembly (1).

As to particular embodiments, the illuminated assembly (1) can further include one or more position sensors, which can sense a position of one or more of a panel (5), a first sheet (8), a second sheet (32), a front cover (110), a back cover (111), or any movable component of the illuminated assembly (1) to activate the light source (3) to the activated condition (4) in response to the movement of one or more movable components of the illuminated assembly (1). As an illustrative example, when the front cover (110) of an illuminated assembly (1) in a closed condition is moved to provide an open condition of the illuminated assembly, the position sensor can sense the movement of the front cover (110) and accordingly provide an activation signal to the light source (3), the power source (67), the actuator (68), or the like, to generate the activated condition (4), whereby the light source (3) provides light (11) to each panel (5).

A method of producing an illuminated assembly (1) can include coupling a plurality of pages (2) to one another, whereby each page (2) can be produced by providing a panel (5) having a panel first surface (6) opposite a panel second surface (7); providing a first sheet (8) having a first sheet front surface (9) opposite a first sheet back surface (10); disposing at least one first sheet light transmission portion (21) within the first sheet (8), the first sheet light transmission portion (21) communicating between the first sheet front and back surfaces (9)(10); and coupling the first sheet back surface (10) to the panel first surface (6). The method can further include operatively coupling a light source (3) to each panel (5), whereby the light source (3) in an activated condition (4) can provide light (11) to each corresponding panel first surface (6). Accordingly, the light (11) can be transmitted from each panel first surface (6) through each corresponding first sheet light transmission portion (21) such that the light (11) can be viewable by a viewer (22) of the first sheet front surface (9).

As to particular embodiments, the method can further include providing the panel (5) as a light-diffusing panel (14) configured to diffuse the light (11) provided by the light source (3). As to particular embodiments, the method can further include providing the light-diffusing panel (14) configured to diffuse the light (11) provided by the light source (3) to generally uniformly illuminate the panel first surface (6). As to particular embodiments, the method can further include providing the light-diffusing panel (14) configured to diffuse the light (11) provided by the light source (3) when the light (11) is provided proximate a panel first edge (15).

As to particular embodiments, the method can further include providing the light-diffusing panel (14) having one or more light-diffusing elements (16) selected from the group including or consisting of: light-diffusing particles (17) embedded within the light-diffusing panel (14) and a pattern (19) coupled to the light-diffusing panel (14), whereby the light-diffusing elements (16) can be configured to diffuse the light (11) provided by the light source (3).

As to particular embodiments, the method can further include providing the first sheet light transmission portion (21) having one or more configurations selected from the group including or consisting of: a generally transparent material (23), a generally translucent material (24), and an aperture element (25) defining an aperture element opening (26) communicating between the first sheet front and back surfaces (9)(10).

As to particular embodiments, the method can further include disposing indicia (30) on one or more surfaces selected from the group including or consisting of: the panel first surface (6), whereby the indicia (30) can be viewable through the first sheet light transmission portion (21) overlaying the indicia (30); the second sheet back surface (31), whereby the indicia (30) can be viewable through both the first sheet light transmission portion (21) and a portion of the panel (5) overlaying the indicia (30); and the first sheet front surface (9).

As to particular embodiments, the method can further include producing each page (2) by providing a second sheet (32) having a second sheet front surface (36) opposite a second sheet back surface (31); disposing at least one second sheet light transmission portion (37) within the second sheet (32), the second sheet light transmission portion (37) communicating between the second sheet front and back surfaces (36)(31); and coupling the second sheet back surface (31) to the panel second surface (7), whereby the light source (3) in the activated condition (4) can provide light (11) to each corresponding panel second surface (7). Accordingly, the light (11) can be transmitted from each panel second surface (7) through each corresponding second sheet light transmission portion (37) such that the light (11) can be viewable by a viewer (22) of the second sheet front surface (36).

As to particular embodiments, the method can further include providing the light-diffusing panel (14) configured to diffuse the light (11) provided by the light source (3) to generally uniformly illuminate the panel second surface (7).

As to particular embodiments, the method can further include providing the second sheet light transmission portion (37) having one or more configurations selected from the group including or consisting of: a generally transparent material (23), a generally translucent material (24), and an aperture element (25) defining an aperture element opening (26) communicating between the second sheet front and back surfaces (36)(31).

As to particular embodiments, the method can further include disposing indicia (30) on one or more surfaces selected from the group including or consisting of: the panel second surface (7), whereby the indicia (30) can be viewable through the second sheet light transmission portion (37) overlaying the indicia (30); the first sheet back surface (31), whereby the indicia (30) can be viewable through both the aperture element opening (26) and a portion of the panel (5) overlaying the indicia (30); and the second sheet front surface (36).

As to particular embodiments, the method can further include configuring the light source (3) to provide the light (11) to each the panel (5) proximate each corresponding panel first edge (15). As to particular embodiments, the light source (3) can be selected from the group including or consisting of: a light-emitting diode (LED) light source (56), an incandescent light source, a fluorescent light source, an electroluminescent light source, a bioluminescent light source, a chemiluminescent light source, a phosphorescent light source, and an ultraviolet light source.

As to particular embodiments, the method can further include housing the light source (3) within a light source housing (61). As to particular embodiments, the method can further include coupling the light source housing (61) to each panel (5) to provide the light (11) proximate each corresponding panel first edge (15). As to particular embodiments, the method can further include removably coupling the light source housing (61) to each panel (5). As to particular embodiments, the method can further include slidably engaging the light source housing (61) with each panel (5), whereby in an engaged condition (66), the light source (3) can provide the light (11) to each panel (5) proximate each corresponding panel first edge (15).

As to particular embodiments, the method can further include operatively coupling a power source (67) to the light source (3) to generate the activated condition (4) whereby the light source (3) can provide the light (11) to each panel (5) proximate each corresponding panel first edge (15).

As to particular embodiments, the method can further include providing a coupler (71); coupling each panel (5) to the coupler (71); and coupling the light source (3) to the coupler (71); whereby the coupler (71) can be configured to couple each panel (5) to the light source (3) to provide the light (11) proximate each corresponding panel first edge (15).

As to particular embodiments, the method can further include providing the coupler (71) configured as a coupler tubular member (72) having a plurality of elongate slots (76) communicating between a coupler tubular member external surface (77) and a coupler tubular member internal surface (78) which defines a coupler tubular member interior space (79); and engaging each panel (5) within a corresponding elongate slot (76); whereby each elongate slot (76) can be configured to receive the panel (5) to dispose the corresponding panel first edge (15) proximate the coupler tubular member interior space (79). As to particular embodiments, the method can further include removably telescopingly engaging the light source housing (61) within the coupler tubular member interior space (79).

As to particular embodiments, the method can further include providing a seating element tubular member (97) having a seating element tubular member external surface (98) and a seating element tubular member internal surface (99) which defines a seating element tubular member interior space (100); coupling a plurality of elongate seats (101) to the seating element tubular member external surface (98); and rotatably engaging each panel first edge (15) within each corresponding elongate seat (101). As to particular embodiments, the method can further include telescopingly engaging the seating element tubular member (97) within the coupler tubular member interior space (79) to align the plurality of elongate seats (101) with the plurality of elongate slots (76) disposed within the coupler tubular member (72). As to particular embodiments, the method can further include removably telescopingly engaging the light source housing (61) within the seating element tubular member interior space (100).

As to particular embodiments, the method can further include providing a binding assembly (107) including a spine element (109) coupled between front and back covers (110)(111); and coupling the light source (3) between the spine element (109) and the plurality of pages (2).

As can be easily understood from the foregoing, the basic concepts of the present invention may be embodied in a variety of ways. The invention involves numerous and varied embodiments of an illuminated assembly and methods for making and using such illuminated assemblies, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the illuminated assemblies herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. An illuminated assembly comprising:

a plurality of pages coupled to one another, each said page comprising:

a light-diffusing panel having a panel first surface opposite a panel second surface;

a first sheet having a first sheet front surface opposite a first sheet back surface, said first sheet back surface in overlapping engagement with said panel first surface;

at least one first sheet light transmission portion disposed within said first sheet, said first sheet light transmission portion communicating between said first sheet front and back surfaces; and a light source operatively coupled to said light-diffusing panel, said light source in an activated condition provides light to said panel first surface;

wherein said light is transmitted from said panel first surface through said first sheet light transmission portion such that said light is viewable by a viewer of said first sheet front surface.

2. The illuminated assembly of claim 1, wherein said light-diffusing panel diffuses said light provided by said light source to substantially uniformly illuminate said panel first surface.

3. The illuminated assembly of claim 2, wherein said light-diffusing panel diffuses said light provided by said light source when said light is provided proximate a panel first edge.

4. The illuminated assembly of claim 3, wherein said light-diffusing panel comprises one or more light-diffusing elements selected from the group consisting of: light-diffusing particles embedded within said light-diffusing panel and a pattern coupled to said light-diffusing panel, said light-diffusing elements configured to diffuse said light provided by said light source.

5. The illuminated assembly of claim 1, wherein said first sheet light transmission portion comprises one or more configurations selected from the group consisting of: a generally transparent material, a generally translucent material, and an aperture element defining an aperture element opening communicating between said first sheet front and back surfaces.

6. The illuminated assembly of claim 1, each said page further comprising:

a second sheet having a second sheet front surface opposite a second sheet back surface, said second sheet back surface in overlapping engagement with said panel second surface; and at least one second sheet light transmission portion disposed within said second sheet, said second sheet light transmission portion communicating between said second sheet front and back surfaces;

wherein said light source in said activated condition provides light to said panel second surface; and wherein said light is transmitted from said panel second surface through said second sheet light transmission portion such that said light is viewable by a viewer of said second sheet front surface.

7. The illuminated assembly of claim 6, wherein said light-diffusing panel diffuses said light provided by said light source to substantially uniformly illuminate said panel second surface.

8. The illuminated assembly of claim 6, wherein said second sheet light transmission portion comprises one or more configurations selected from the group consisting of: a generally transparent material, a generally translucent material, and an aperture element defining an aperture element opening communicating between said second sheet front and back surfaces.

9. The illuminated assembly of claim 1, wherein said light source provides said light to said light-diffusing panel proximate a panel first edge.

10. The illuminated assembly of claim 9, wherein said light source is selected from the group consisting of: a light-emitting diode (LED) light source, an incandescent light source, a fluorescent light source, an electroluminescent light source, a bioluminescent light source, a chemiluminescent light source, a phosphorescent light source, and an ultraviolet light source.

11. The illuminated assembly of claim 9, further comprising a power source operatively coupled to said light source to generate said activated condition wherein said light source provides said light to said light-diffusing panel proximate said panel first edge.

12. The illuminated assembly of claim 1, wherein said first sheet is formed from a generally opaque material which precludes light transmission such that said light provided by said light source is only transmitted through said first sheet light transmission portion.

13. The illuminated assembly of claim 6, wherein said first and second sheets are formed from a generally opaque material which precludes light transmission such that said light provided by said light source is only transmitted through said first and second sheet light transmission portions.

14. The illuminated assembly of claim 1, wherein said first sheet further comprises one or more indicia disposed on said first sheet front surface.

15. The illuminated assembly of claim 6, wherein said first and second sheets further comprise one or more indicia disposed on corresponding said first and second sheet front surfaces.

16. The illuminated assembly of claim 1, further comprising a light altering element disposed between said first sheet back surface and said panel first surface.

17. The illuminated assembly of claim 16, wherein said light altering element comprises a colored translucent material.

18. The illuminated assembly of claim 6, further comprising a light altering element disposed:

between said first sheet back surface and said panel first surface; and between said second sheet back surface and said panel second surface.

19. The illuminated assembly of claim 18, wherein said light altering element comprises a colored translucent material.

20. The illuminated assembly of claim 1, wherein said light-diffusing panel comprises substantially transparent material.

21. The illuminated assembly of claim 1, wherein said light-diffusing panel comprises substantially translucent material.

22. The illuminated assembly of claim 1, wherein said first sheet light transmission portion comprises an aperture element defining an aperture element opening communicating between said first sheet front and back surfaces.

23. An illuminated assembly comprising:

a plurality of pages coupled to one another, at least one said page comprising:

a light-diffusing panel having a panel first surface opposite a panel second surface;

a first sheet having a first sheet front surface opposite a first sheet back surface, said first sheet back surface in overlapping engagement with said panel first surface;

at least one first sheet light transmission portion disposed within said first sheet, said first sheet light transmission portion communicating between said first sheet front and back surfaces; and a light source operatively coupled to said light-diffusing panel, said light source in an activated condition provides light to said panel first surface;

wherein said light is transmitted from said panel first surface through said first sheet light transmission portion such that said light is viewable by a viewer of said first sheet front surface.

24. An illuminated assembly comprising:

a plurality of pages coupled to one another;

a light-diffusing panel having a panel first surface opposite a panel second surface;

a first sheet having a first sheet front surface opposite a first sheet back surface, said first sheet back surface in overlapping engagement with said panel first surface;

at least one first sheet light transmission portion disposed within said first sheet, said first sheet light transmission portion communicating between said first sheet front and back surfaces; and a light source operatively coupled to said light-diffusing panel, said light source in an activated condition provides light to said panel first surface;

wherein said light is transmitted from said panel first surface through said first sheet light transmission portion such that said light is viewable by a viewer of said first sheet front surface.

* * * * *